US005512729A

United States Patent [19]

Kusaka et al.

[11] Patent Number: 5,512,729

[45] Date of Patent: Apr. 30, 1996

[54] IMAGE HEATING APPARATUS COMPRISING BACKUP ROLLER PROVIDED WITH HEAT CONDUCTING MEMBER OR CLEANING MEMBER

[75] Inventors: Kensaku Kusaka, Kawasaki; Koji Masuda; Manabu Takano, both of Tokyo, all of Japan

[73] Assignee: Canon Kabushiki Kaisha, Tokyo, Japan

[21] Appl. No.: 159,210

[22] Filed: Nov. 30, 1993

[30] Foreign Application Priority Data

Dec. 4, 1992 [JP] Japan ..... 4-350232
Feb. 24, 1993 [JP] Japan ..... 5-058067

[51] Int. Cl.[6] ..... G03G 15/20

[52] U.S. Cl. ..... 219/216; 355/283

[58] Field of Search ..... 219/216, 469, 219/470, 471; 355/290, 284, 283

[56] References Cited

U.S. PATENT DOCUMENTS 3,792,925 2/1974 Milligan et al. ..... 355/300
3,861,860 1/1975 Thettu et al. ..... 219/216
4,272,666 6/1981 Collin ..... 219/216
4,989,048 1/1991 Arai et al. ..... 355/299
5,026,276 6/1991 Hirabayashi et al. .
5,043,768 8/1991 Baruch ..... 355/284
5,132,739 7/1992 Mauer et al. ..... 355/284
5,149,941 9/1992 Hirabayashi et al. .
5,177,551 1/1993 Arnold ..... 355/284
5,262,834 11/1993 Kusaka et al. .
5,270,776 12/1993 Landa ..... 355/290
5,287,155 2/1994 Arai et al. ..... 219/216
5,359,398 10/1994 Echigo et al. ..... 355/256

*Primary Examiner*—Teresa J. Walberg
*Assistant Examiner*—Gregory L. Mills
*Attorney, Agent, or Firm*—Fitzpatrick, Cella, Harper & Scinto

[57] ABSTRACT

An image heating apparatus has a heater, a film for transferring heat from the heater to an image on a recording material, a rotary backup member for forming a nip with the film and a cleaning member for cleaning a peripheral surface of the rotary backup member. A device for moving the cleaning member is provided so that the cleaning member comes in contact with, or moves away from, the surface of the rotary backup member such that the moving device places the cleaning member in contact with the surface of the rotary backup member after the temperature of the rotary backup member increases.

4 Claims, 19 Drawing Sheets

IMAGE HEATING APPARATUS COMPRISING BACKUP ROLLER PROVIDED WITH HEAT CONDUCTING MEMBER OR CLEANING MEMBER

FIELD OF THE INVENTION AND RELATED ART

The present invention relates to an image heating apparatus for heating an image on a sheet of recording material, in particular to an image heating apparatus suitable to be used in an apparatus for heating an unfixed image on the recording material.

In the past, as an image heating apparatus used for fixing thermally an unfixed image or altering the surface properties of the image, a heat roller type image heating apparatus has been in wide use, in which the recording material carrying the image is driven forward by a heating roller and a pressure roller, while being compressed between them. In this heat roller type apparatus, the thermal capacity of the heat roller is rather large; therefore, it has suffered from a problem of the excess time it takes for the heat roller to reach a predetermined temperature (so-called warmup time).

In the U.S. Pat. No. 5,149,941 and Ser. No. 444,802, a through-film thermal fixing system is disclosed, in which a low thermal capacity thermal head and a piece of thin film which slides on this thermal head are employed in order to shorten this warmup time.

However, this through-film heating system also has its own problem, that is, contamination caused by toner off-set. Therefore, it is preferable for a cleaner to be provided.

In this case, it is more preferable to clean the pressure roller, but since there is only a short time from when the power is turned on to when the recording material is subjected to a fixing process, the cleaning roller has to remain in contact with the pressure roller in order to prevent pressure roller contamination. Therefore, the heat energy transmitted from the heater, through the film, to the pressure roller, is transferred further to the cleaning roller. As a result, the rate at which the heater temperature increases is smaller compared to the rate without the cleaning roller.

There is another problem in which the durability of the heater or film deteriorates from the excess temperature increase in a non-sheet passage portion of the heater.

The heater employed in the apparatus described in the foregoing comprises an electrical exothermic layer, which, as the power is supplied, generates across its entire length a given amount of heat per unit length, so that the surface of the recording material fed through the apparatus is thermally processed in the same manner whether the fed recording material is of the widest width or the various smaller widths.

However, in prior heaters in which the exothermic layer generates across its entire range a given amount of heat per unit length, when the width of the recording material fed in the apparatus is smaller than the maximum usable range of the heater, a so-called non-sheet passage temperature increase occurs at a non-sheet passage portion of the heater, in the longitudinal direction of the heater; creating thereby problems such as shortening of the service life of the apparatus caused by the thermal damage to the heater or heater supporting members, deterioration of the durability of the film and the like, or instability in film advance (wrinkling or snaking of the film).

SUMMARY OF THE INVENTION

Accordingly, a primary object of the present invention is to provide an image heating apparatus capable of preventing the contamination of the apparatus, without causing heating failure.

Another object of the present invention is to provide an image heating apparatus capable of preventing an excessive temperature increase in the non-sheet passage region.

According to an aspect of the present invention, the image heating apparatus comprises: a heater; a film for transferring the heat from the heater to an image on a recording material; a rotary backup member for forming a nip in coordination with the film; a cleaning member for cleaning the peripheral surface of the rotary backup member; moving means for moving the cleaning member so that it comes in contact with, or it moves away from, the surface of the rotary backup member; wherein the moving means places the cleaning member in contact with the surface of the rotary backup member after the temperature of the rotary backup member increases.

According another aspect of the present invention, the image heating apparatus comprises: a heater; a film for transferring the heat from the heater to an image on a recording material; a rotary backup member for forming a nip in coordination with the film; and a heat conducting member provided for the rotary backup member, being arranged in parallel to the generating line.

These and other objects, features and advantages of the present invention will become more apparent upon a consideration of the following description of the preferred embodiments of the present invention, taken in conjunction with the accompanying drawings.

DESCRIPTION OF THE PREFERRED EMBODIMENTS

Figure 1:
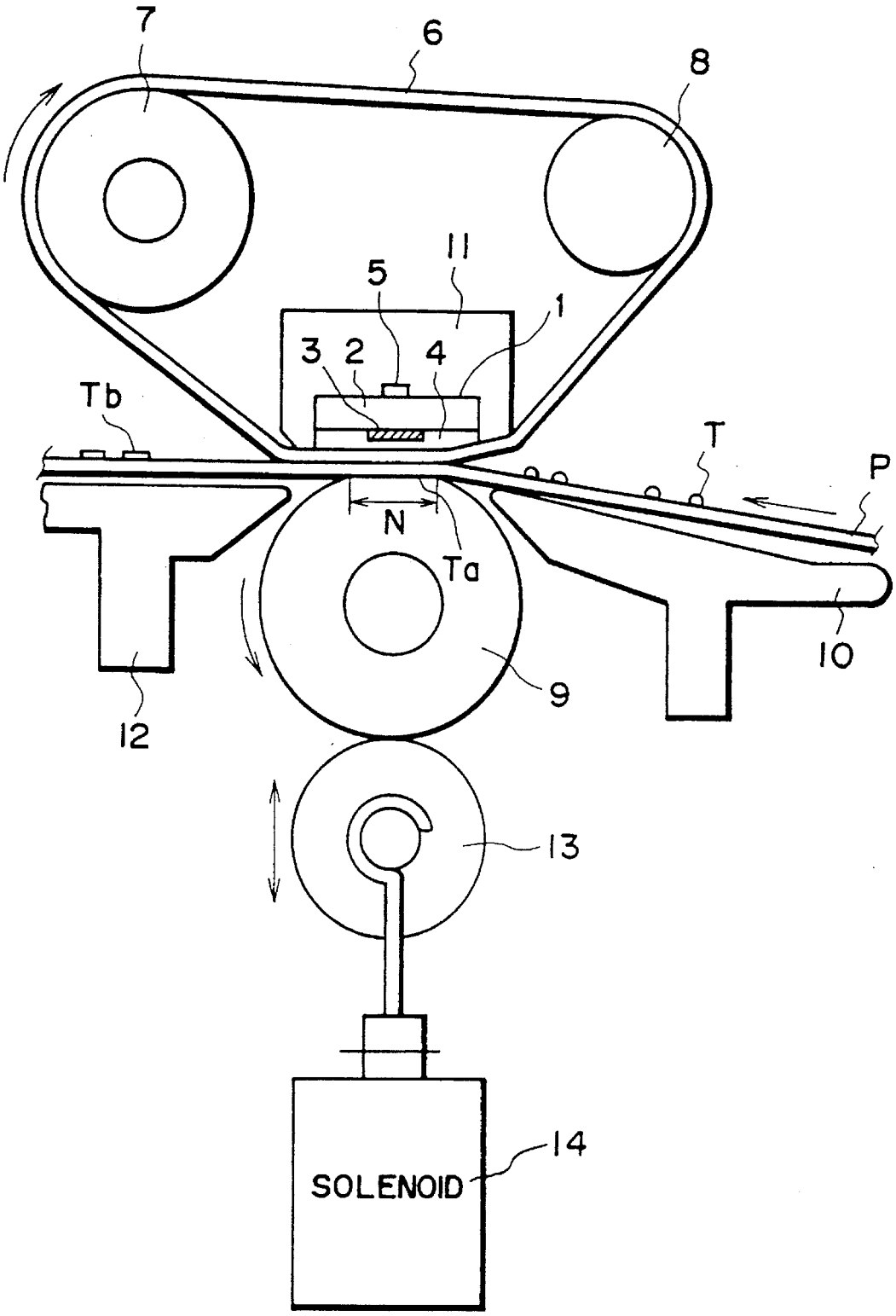
FIG. 1 is a schematic view of a preferred embodiment of the fixing apparatus in accordance with the present invention.
Figure 2:
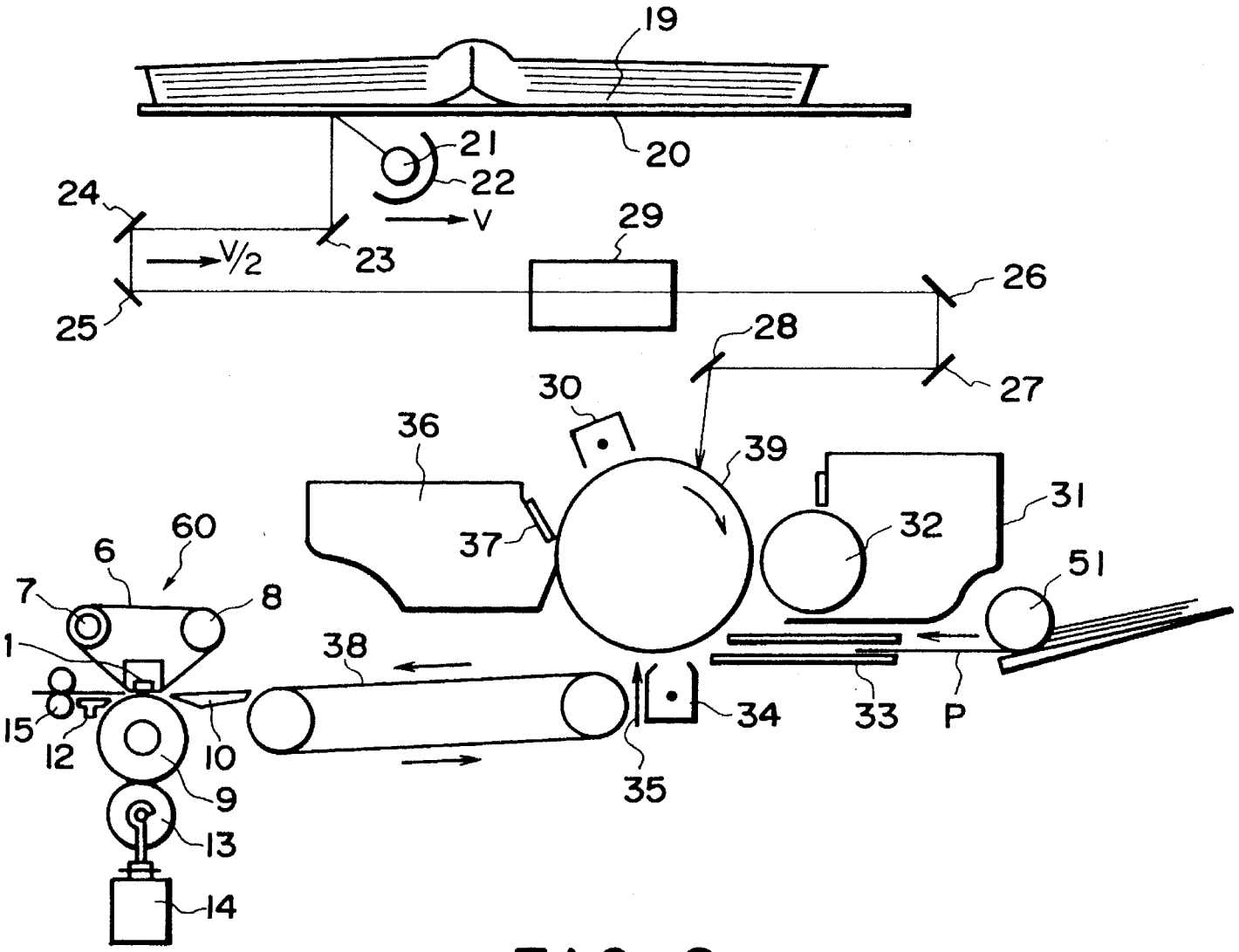
FIG. 2 is a schematic view of an image forming apparatus provided with the fixing apparatus shown in FIG. 1.

FIG. 1 is a sectional view of a preferred embodiment of the image heating apparatus in accordance with the present invention, and FIG. 2 is a sectional view of an image forming apparatus employing the embodiment shown in FIG. 1 as the fixing apparatus.

Referring to FIG. 2, the image forming apparatus employing the embodiment of the present invention is an electrophotographic copying machine comprising a fixed document table, a moving optical system, and a rotary transfer drum. In this embodiment, an original 19 is placed on the fixed document table 20 of glass as shown in FIG. 2. After a given number of copying conditions are set, a start key is pressed. Then, a photosensitive drum 39 begins to be rotatively driven in the clockwise direction indicated by an arrow mark, at a predetermined peripheral velocity. A light source 21 (22 is a reflective shade) and the first mirror 23 move from the home position at the left side of the document table 20 of glass to the right end, following 10 the bottom surface of the glass, at a speed of V, and the second and third mirrors 24 and 25 move in the same direction at a speed of V/2, whereby the downward facing image bearing surface of the original 19 placed on the document table 20 of glass is scanned from the left side to the right side by the light, and the scanning light reflected by the surface of the original is focused, through the fourth, fifth and sixth fixed mirrors 26, 27 and 28, on the surface of the rotary photosensitive drum 39, exposing the surface with the focused image (slit-exposed).

Before the exposure, the surface of the rotary photosensitive drum 39 is uniformly charged by the first charger 30, to positive or negative polarity, and as this charged surface is exposed as described in the foregoing, an electrostatic latent image corresponding to the image on the original is formed on the drum 39. The electrostatic latent image formed on the photosensitive drum 39 is visualized as an image composed of toner particles, by a developing roller 32 of a developing device 31.

Meanwhile, a recording material P is fed by a feed roller 51, passed through a guide 33, and introduced, with a predetermined timing, into a transfer station formed between the drum 39 and a transfer charger 34, where it is subjected to a transfer corona, being thereby attracted to the drum 39, when the visual toner image is transferred onto the surface of the recording material as contact is made.

The recording material P passed through the image transfer station is separated from the surface of the drum 39 as the recording material P is cleared of the charge remaining on the back surface, by a charge clearing needle 35, and is guided into a fixing apparatus 6 by a conveying member 38 and an entrance guide 10, where the toner image is fixed as will be described later, and then, the recording material P now bearing a fixed image is discharged as a copy.

After the transfer operation, the surface of the drum 39 is cleared of contamination such as residual toner or the like, by a cleaning blade 37 of a cleaning device 36, to be prepared for the following image forming cycle.

The apparatus is designed so that the moving optical system members 21–25 move forward as was described in the foregoing, and move backward after they reach a predetermined terminal. After returning to the home position where they start, they remain at standby until the next copying cycle begins (hereinafter, this process is called optical system backing sequence).

When the copy count is selected to be two or more (for example, 100 copies) before the copy start key is pressed, the sequence described in the foregoing is repeated with predetermined intervals, under the control of a microcomputer (hereinafter, MPU) shown in FIG. 3, after the optical system backing sequence.

Next, referring to FIG. 1, an embodiment of the fixing apparatus 60 in accordance with the present invention will be described in detail. In FIG. 1, reference numeral 6 designates an endless belt of fixing film, which is stretched around a driving roller 7 on the left, a follower roller 8 on the right, and a small heat capacity linear heater 1 affixed below the middle point between these two rollers 7 and 8.

The follower roller 8 doubles as a tension roller for tensing the fixing film 8 in the outward direction of the loop. The peripheral surface of the driving roller 7 is covered with silicone rubber or the like to increase the friction coefficient. As the driving roller 7 is rotatively driven in the clockwise direction, the fixing film is advanced in the clockwise direction at a predetermined peripheral velocity, without wrinkling, snaking, or falling behind the speed of the driving roller 7.

A reference numeral 9 designates a pressure roller provided with an elastic layer made of rubber, such as silicone rubber, with excellent parting properties, which presses the bottom portion of the loop of the aforementioned endless fixing film belt 6 against the downward facing surface of the heater 1, with a contact pressure of, for example, 5 kg/cm to 10 kg/cm generated by a pressure generating means such as a spring, and rotates in the counterclockwise direction, that is, the same direction as the one in which the recording material P is conveyed.

A reference numeral 13 designates a cleaning roller which can be placed in contact with, or moved away from, the pressure roller 9. The cleaning roller 13 comprises a metallic core and a silicone sponge layer which covers the core, and the surface of the silicone sponge layer is covered with felt of aramide fibers (commercial name: NORMEX, DuPont). Further, the cleaning roller 13 is moved by a solenoid 14, to be placed in contact with, or moved away from, the pressure roller 19, with a predetermined timing.

As for the material for the rotatively driven endless fixing film 6, since it is repeatedly used for fixing thermally the toner image, material with excellent heat resistance, separativeness, and durability, is employed. Generally speaking, its thickness is less than 100 μm, preferably no more than 40 μm. As an example, it is an endless belt with an overall thickness of 30 μm, comprising a 20 μm thick endless base film and a 10 μm thick separative layer coated on the outward facing peripheral surface the base film, wherein the base film is a thin film of highly heat resistant resin, such as polyimide, polyether imide, polyether sulfon, polyether, or ether ketone, or is a thin film of metal such as nickel or SUS, and the separative layer is composed of a low surface energy resin such as PTFE (tetrafluoroethylene) or PRA (copolymer of tetrafluoroethylene and perfluoroalkyl vinyl ether), or a mixture of these low surface energy resins and an electrically conductive material such as carbon black.

The small heat capacity heater 1 comprises a substrate 2, an exothermic layer 3, and a protective layer 4, wherein the substrate 2 is made of alumina and measures 1.0 mm long, 10 mm wide, and 340 mm long; the exothermic layer 3 is made of resistive material such as silver/palladium or ruthenium oxide, and is coated 10 μm thick and 1.0 mm wide on the substrate 2; and the protective layer 4 is 10 μm thick and is made of glass or the like in consideration of the fact that the film slides on it. The heater 1 is fixedly supported on a heater supporting member 11.

The heater supporting member 11 is made of highly heat resistant resin such as PPS (polyphenylene sulfide), PEEK (polyether-ether ketone), liquid crystal polymer, or made of a composite material composed of these resins and ceramics or metals, which are capable of thermally insulating the heater 1 from the fixing apparatus 60 or the image forming apparatus.

The exothermic layer 3 of the heater is supplied with the electric power through the longitudinal opposite ends. The power is a 100 V AC. The power supply to the exothermic layer 3 is controlled by the MPU 18, in response to the temperature detected by a thermistor 5 such as an NTC thermistor which is glued with thermally conductive silicone rubber or the like, is pressure welded, or is integrally formed, on the back surface of the substrate 2.

Figure 3:
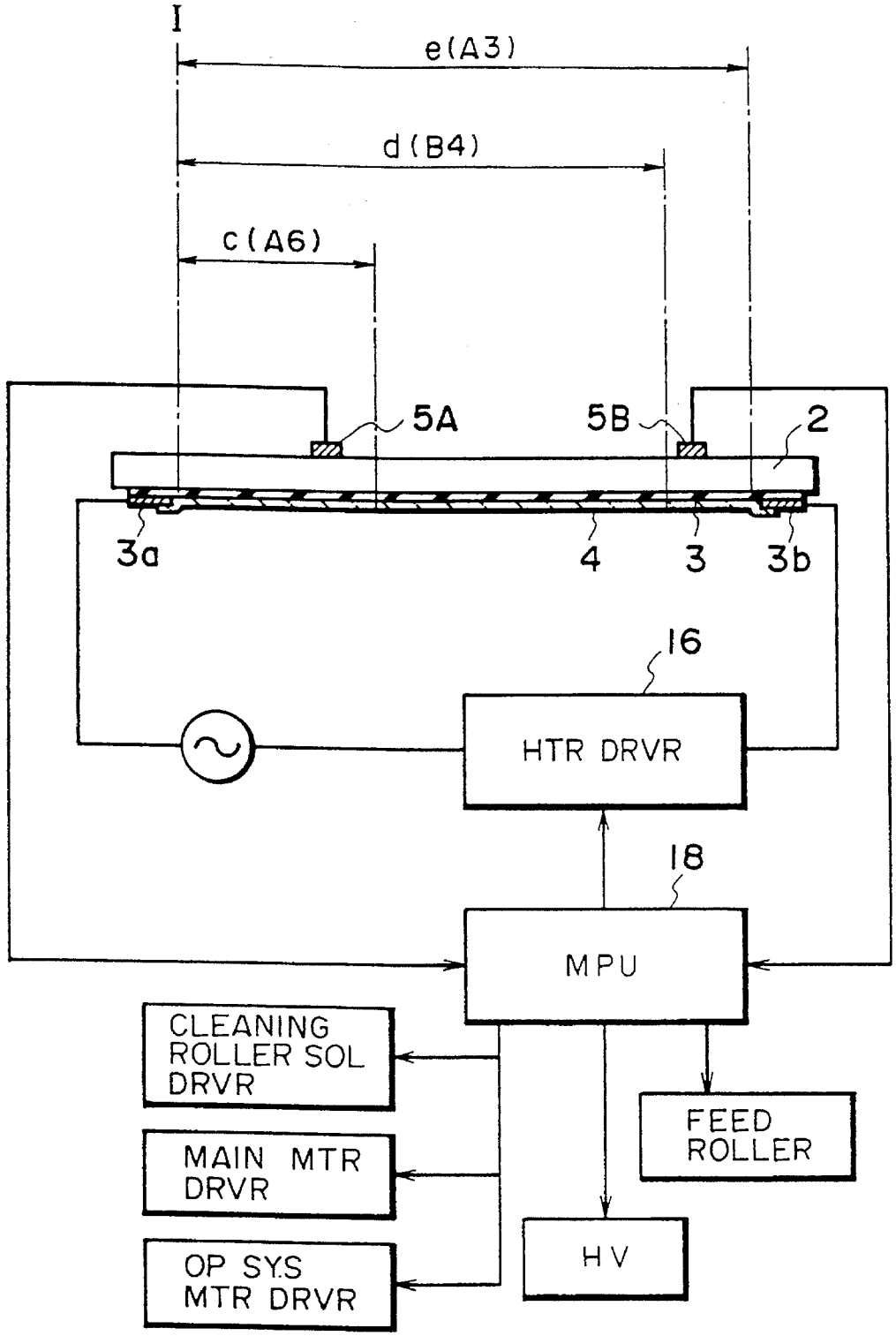
FIG. 3 is a combination of a schematic view of the heating member employed in the apparatus shown in FIG. 1, and a block diagram of the controlling means of the heating member.

FIG. 3 is a side view of the heater 1, as seen from the sheet feeding side. The exothermic layer 3 is formed in a straight line in the longitudinal direction of the substrate, at the substantial middle of the bottom surface of the substrate 2. Reference numerals 3*a* and 3*b* designate electrodes (input terminals) made of excellent conductive material such as silver, being provided at the left and right ends of the exothermic layer 3.

A reference character (e) designates an effective portion of the exothermic layer 3 between these electrodes 3*e* and 3*b*. In this embodiment, it is set up to match the width (297 mm) of the A3 size sheet, the widest recording material which can be handled by the apparatus.

Further, in the image forming apparatus comprising the embodiment of the present invention, a line (I) at the left end of the exothermic layer 3 is used as a sheet alignment reference. In other words, the recording materials of various sizes are fed using the same single lateral side reference. The A6 size (105 mm) recording material is the smallest recording material usable in the image forming apparatus in accordance with this embodiment; therefore, its passage is the narrowest one for the apparatus.

A reference numeral 5A designates a thermistor, that is, the temperature sensing element positioned within the narrowest sheet passage. During the fixing operation, the MPU L8 controls the heater driving circuit 16 to supply the exothermic layer 3 with such an amount of power so that the detected output of the thermistor 5A constantly registers a predetermined value. A reference numeral 5B designates a thermistor, which is positioned outside the narrowest sheet passage and serves as the temperature sensor. In the case of this embodiment, it is positioned within the boundary of the widest sheet passage (e), while remaining outside the sheet passage of the B4 size (257 mm wide) recording material (d).

Figure 4:
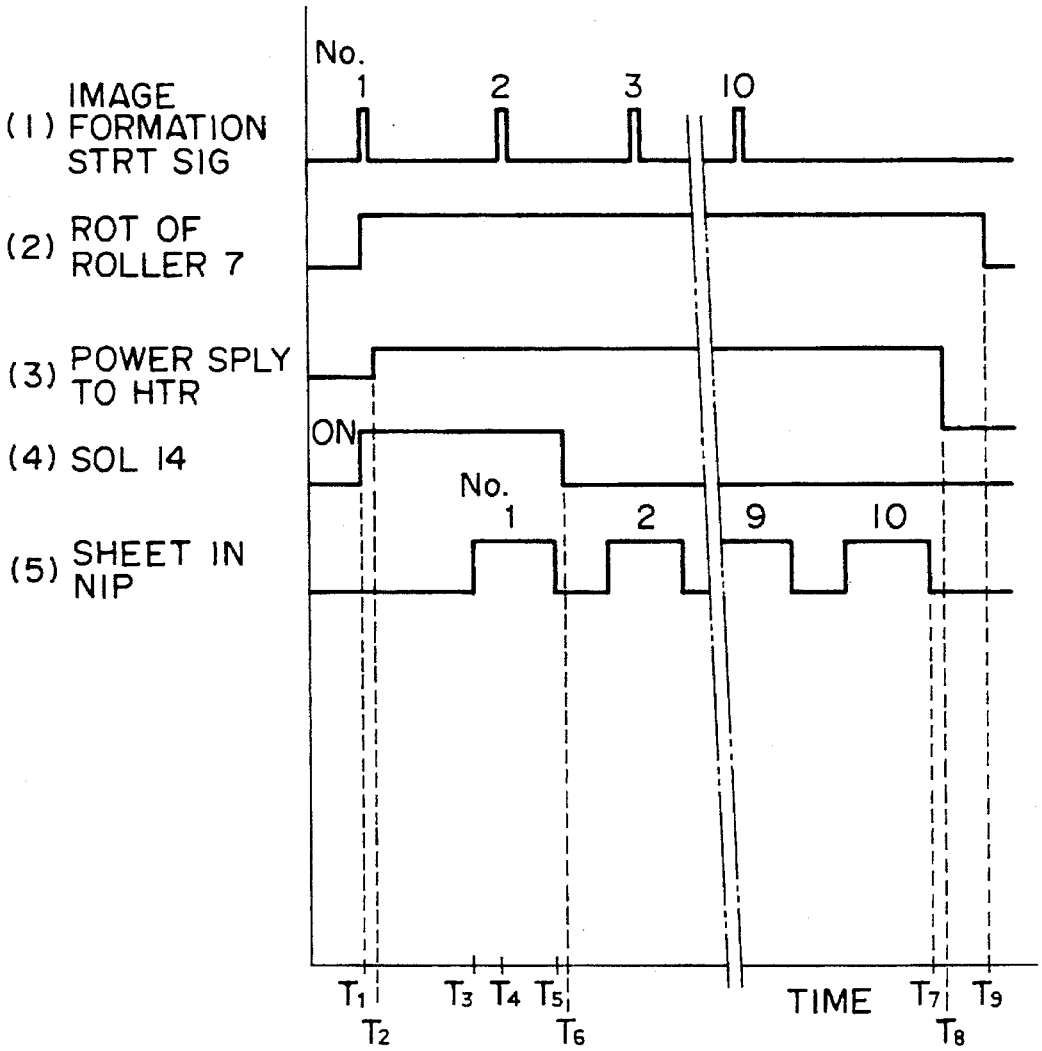
FIG. 4 is an operational timing chart for the cleaning roller in the apparatus shown in FIG. 1.

Next, referring to a timing chart in FIG. 4, a fixing operation in this embodiment will be described. Here, the description is made referring to a case in which a fixing operation for ten sheets is selected in advance by a user. At a time $T_1$ when the image forming apparatus begins the image forming operation in response to an image formation start signal, a cleaning roller solenoid 14 is actuated, whereby the cleaning roller 13 separates from the pressure roller 9. At the same time, the fixing film 6 begins to rotate, and at a time $T_2$ being slightly behind the time $T_1$, the power begins to be supplied to the heater 1. The recording material P bearing an unfixed toner image T on the upper surface is conveyed from the transfer station 34 to the fixing apparatus 60. The recording material P is advanced at a time $T_3$, between the pressure roller 9 and the fixing film 6, in a compression nip N formed by the heater 1, which has been heated to raise quickly its temperature to a predetermined fixing temperature (in this embodiment, 200° C.), and the pressure roller 9, being perfectly in contact with the fixing film 6, with the unfixed toner image facing toward the heater 1. When $T_1$=0, $T_3$=4 sec in this embodiment.

The recording material P fed into the nip N is passed through the nip N, in a manner as if being laminated with the fixing film 6 moving together, while being subjected to the compressing force generated between the heater 1 and the pressure roller 9. Meanwhile, the unfixed toner image receives the heat from the heater 1 through the fixing film 6 as the toner bearing surface of the recording material P passes through the fixing nip N while being compressed upon the fixing film surface, whereby the unfixed toner image is melted by the high temperature and is fused onto the surface of the recording material P, becoming an image Ta.

In the case of this embodiment, the recording material P and fixing film 6 are separated as the recording material P comes out of the fixing nip N. At this time of separation, the temperature of the melted toner Ta is still higher than the glass transition point of the toner, and the toner Ta having a temperature higher than the glass transition point displays a proper amount of rubber-like properties; therefore, the toner image surface does not conform to the fixing film surface, retaining thereby a proper amount of surface irregularities. Since the toner Ta cools down to solidify while retaining these surface properties, the surface of the fixed toner image is free of excessive glossy reflection. In other words, a high quality image is obtained.

While the recording material P separated from the fixing film 6 is guided by a discharge guide 12 to a discharge roller pair 15, the toner Ta having a temperature higher than the glass transition point naturally drops (natural cooling) below the glass transition point, where it solidifies to become an image Tb. After the recording material P is passed through the fixing nip N at a time $T_5$, the recording material P bearing now the fixed image is discharged. Meanwhile, the temperature of the pressure roller 9 rises due to the heat from the heater 1.

The solenoid 14 is deactivated at a time $T_6$ which is slightly behind the time $T_5$, whereby the cleaning roller again comes in contact with the pressure roller, and follows the rotation of the pressure roller to remove the residual toner from the pressure roller surface.

Continuing, the fixing operation is carried out for the second sheet and the rest. Meanwhile, the cleaning roller 13 remains in contact with the pressure roller 9 and continues to be rotated by the rotation of the pressure roller 9 until the power supply to the heater is terminated at a time $T_8$ after the fixing process for the tenth sheet is completed at a time $T_7$.

In a test in which the ambient temperature was changed from 5° C. to 35° C. during the aforementioned operation, the results of fixing were all excellent from the first sheet to the tenth one, at all ambient temperatures. Further, even after the aforementioned cycle was repeated 10,000 times (total of 100,000 times of fixing operations), no contamination was observed on the pressure roller 9 and fixing film 6.

COMPARATIVE EXAMPLE 1

In Embodiment 1, when the solenoid 14 was not provided and the cleaning roller was left in contact with the pressure roller 9, the first recording material P suffered from faulty fixing under the low temperature condition (5° C.). This is because the cleaning roller 13 remained in contact with the pressure roller 9, being rotated by the pressure roller 9, from when the power supply to the heater began until when the recording material P entered the fixing nip N, whereby the pressure roller did not warm up. Also, because the heat from the heater was transmitted to the pressure roller 9 through the fixing film 6 and then to the cleaning roller 13, the heater temperature was slow to rise.

COMPARATIVE EXAMPLE 2

In Embodiment 1, when the cleaning roller 13 was not provided, the surface of the pressure roller was contaminated with the toner after approximately 10,000 pieces of recording material underwent the fixing operation, and this contamination was transferred onto the back surface of the recording material, soiling thereby the recording material P.

Embodiment 2

Next, referring to FIGS. 5 and 6, the second embodiment of the present invention will be described, wherein the same components as those in Embodiment 1 will be designated by the same reference numerals and their description will be omitted.

Figure 5:
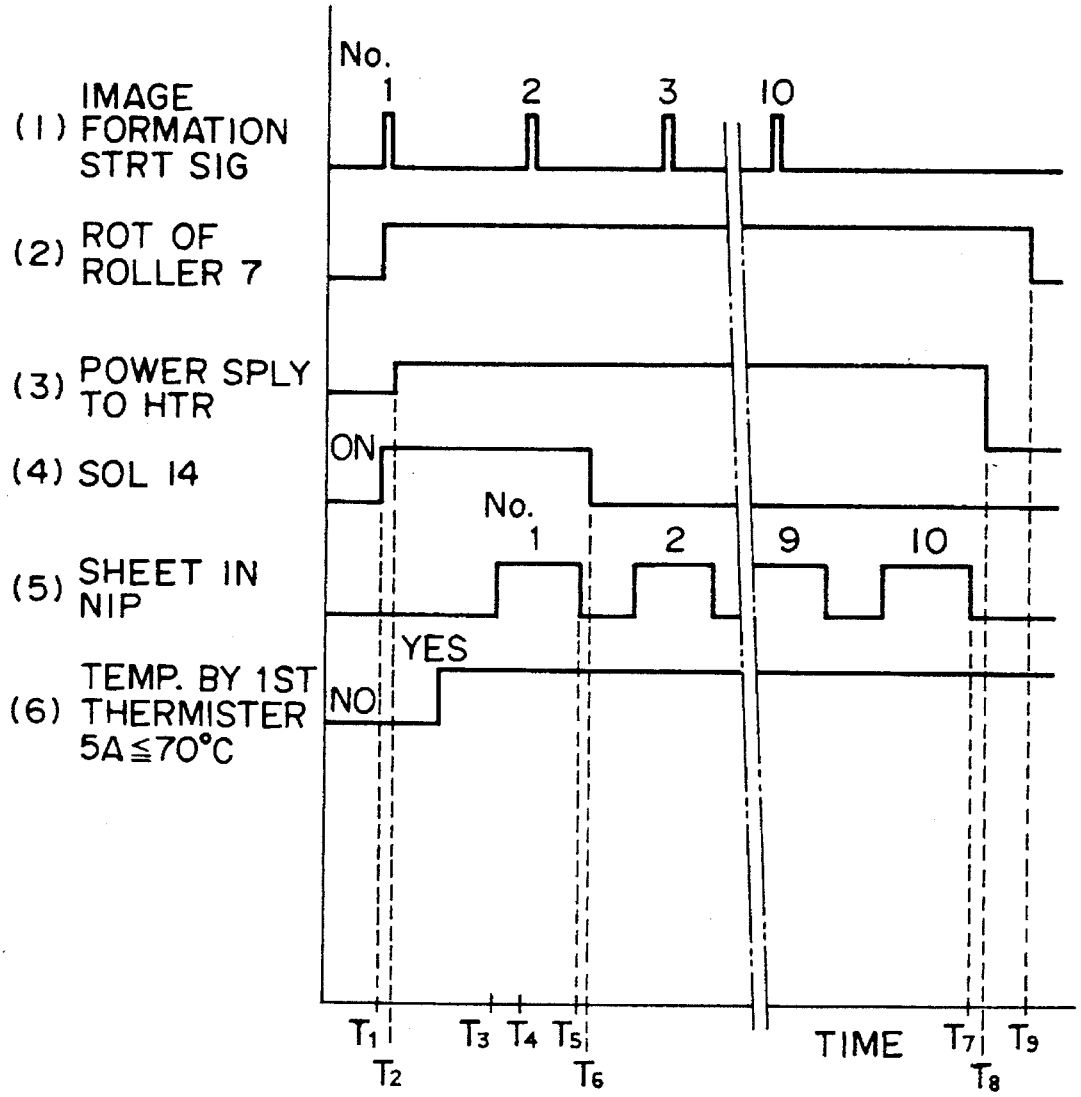
FIG. 5 is an operational timing chart showing the first mode for the cleaning roller in the second embodiment of the present invention.
Figure 6:
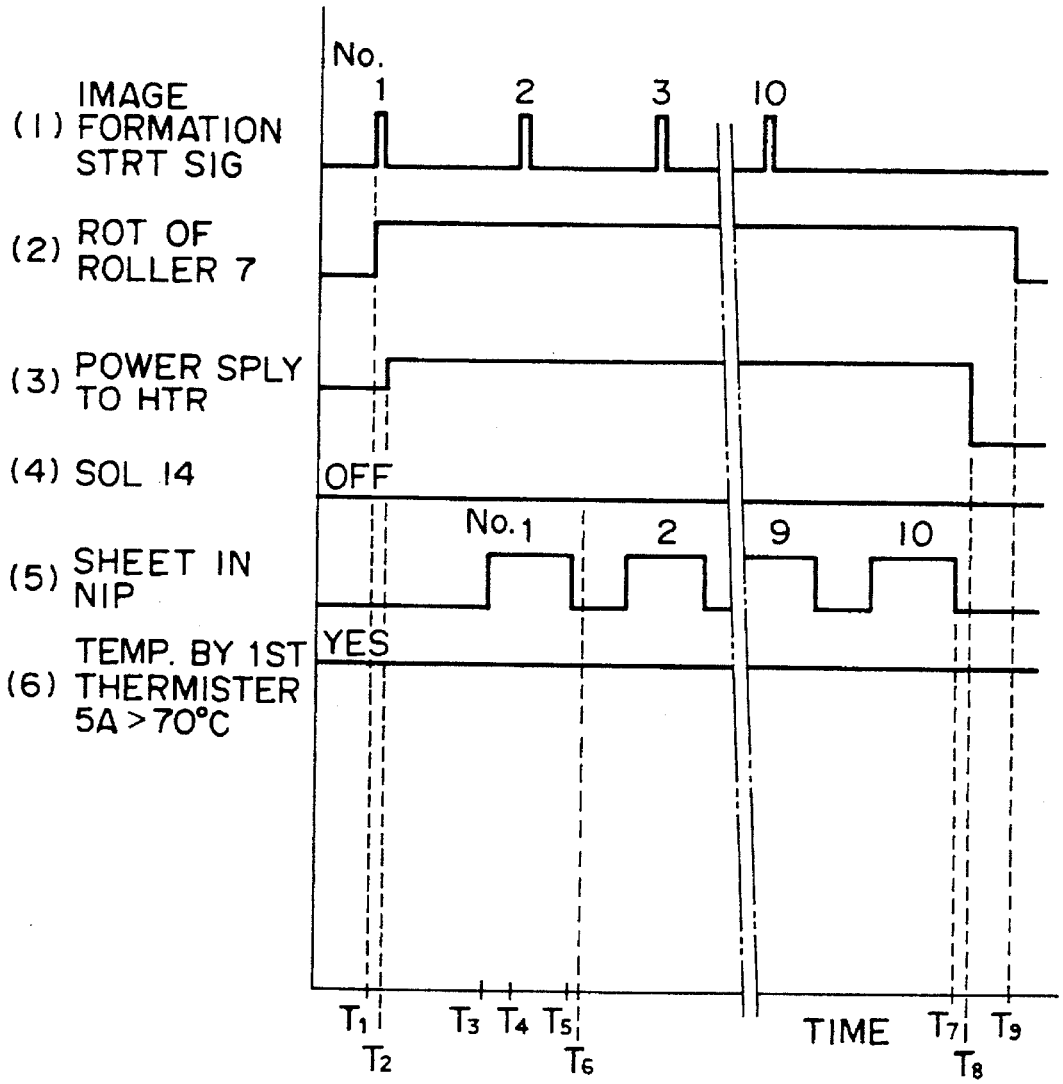
FIG. 6 is an operational timing chart showing the second mode for the cleaning roller in the second embodiment of the present invention.

FIGS. 5 and 6 are timing charts for Embodiment 2. In this embodiment, the operation of the solenoid 14 is varied in response to a temperature $T_{5A}$ detected by the first thermistor 5A when the image formation signal for the first sheet is issued at the time $T_1$.

1) When the detected temperature $T_{5A} \leqq 70°$ C. (FIG. 5), the solenoid 14 is activated at the time $T_1$, and is deactivated at the time $T_6$.

2) When the detected temperature $T_{5A} > 70°$ C. (FIG. 6), it indicates that the fixing operation has been carried out a short while before, and the heater, fixing film, pressure roller, and the like have not yet warmed up; therefore, the solenoid 14 is not going to be activated, whereby the cleaning roller remains in contact with the pressure roller to be rotated.

According to this embodiment, the pressure roller 9 can be better cleaned without deteriorating the fixing performance for the first recording material.

Embodiment 3

Next, referring to FIG. 7, the third embodiment will be described, wherein the same components as those found in Embodiment 1 will be designated by the same reference numerals, and their description will be omitted.

Figure 7:
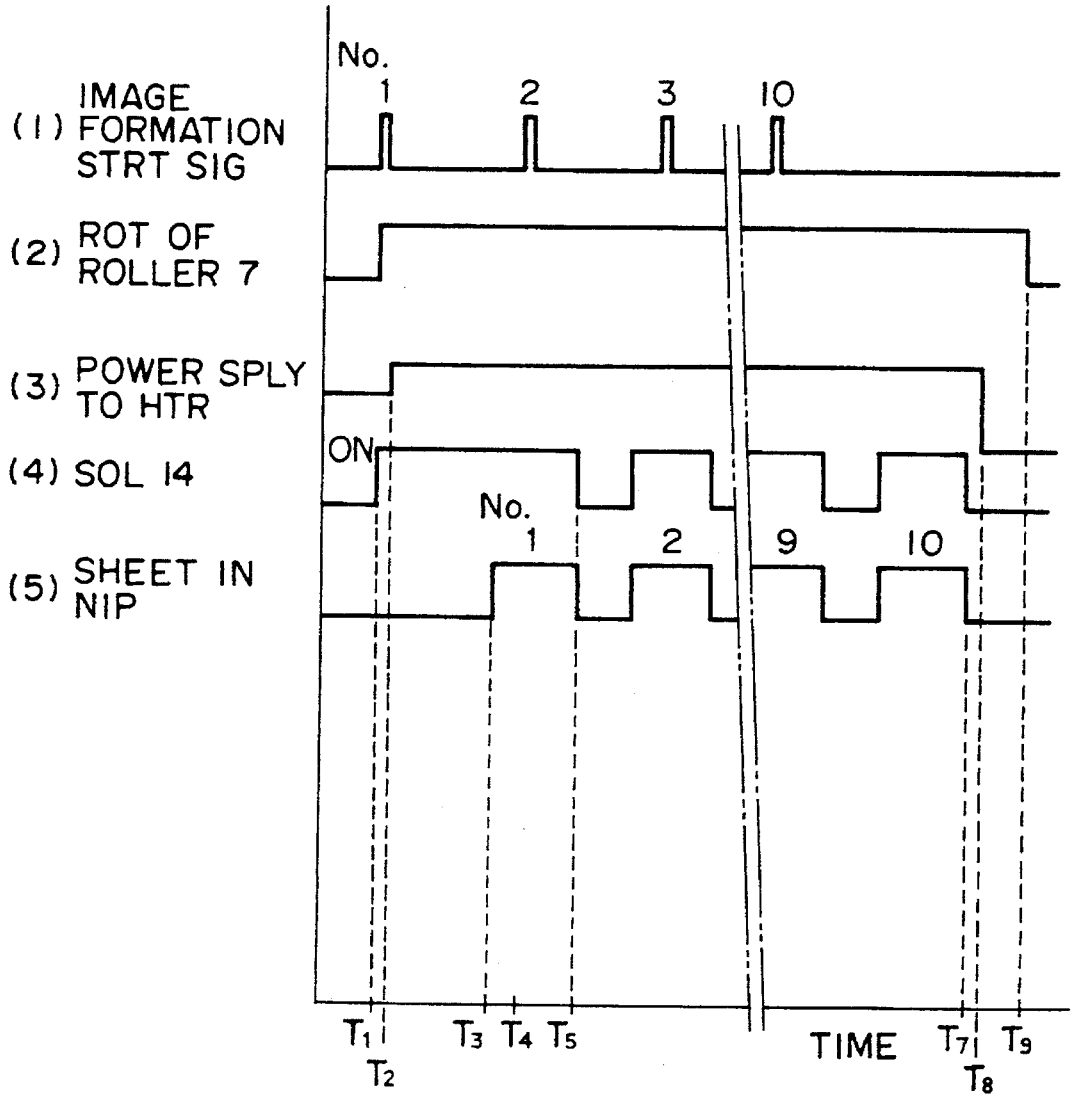
FIG. 7 is an operational timing chart for the cleaning roller in the third embodiment of the present invention.

FIG. 7 is a timing chart for this embodiment. The solenoid 14 is activated at the time $T_1$; is deactivated at the time $T_5$, that is, immediately after the recording material P comes out of the fixing nip; and hereafter, remains activated to keep the cleaning roller off the pressure roller while the recording material P is in the nip.

According to this embodiment, when the cleaning roller is contaminated by the toner or the like after undergoing a large number of the fixing cycles, the surface contamination of the cleaning roller is prevented from adhering to the pressure roller; therefore, the recording material P is prevented from being soiled by the contamination which might have been transferred on the pressure roller 9, were it not for the arrangement according to this embodiment. In particular, even when a large size recording material is fed immediately after the temperatures of the heater, pressure roller, cleaning roller, and the like components have excessively increased at the non-sheet passage portions of them because a large number of the small size recording materials have been consecutively fed, the contamination of the cleaning roller does not adhere to the recording material.

According to this embodiment, the pressure roller 9 can be thermally better insulated from the cleaning roller than in Embodiment 1; therefore, the thermal efficiency improves.

Embodiment 4

Next, referring to FIG. 8, the fourth embodiment of the present invention will be described, wherein the same components as those found in Embodiment 1 will be designated by the same reference numerals, and their description will be omitted.

Figure 8:
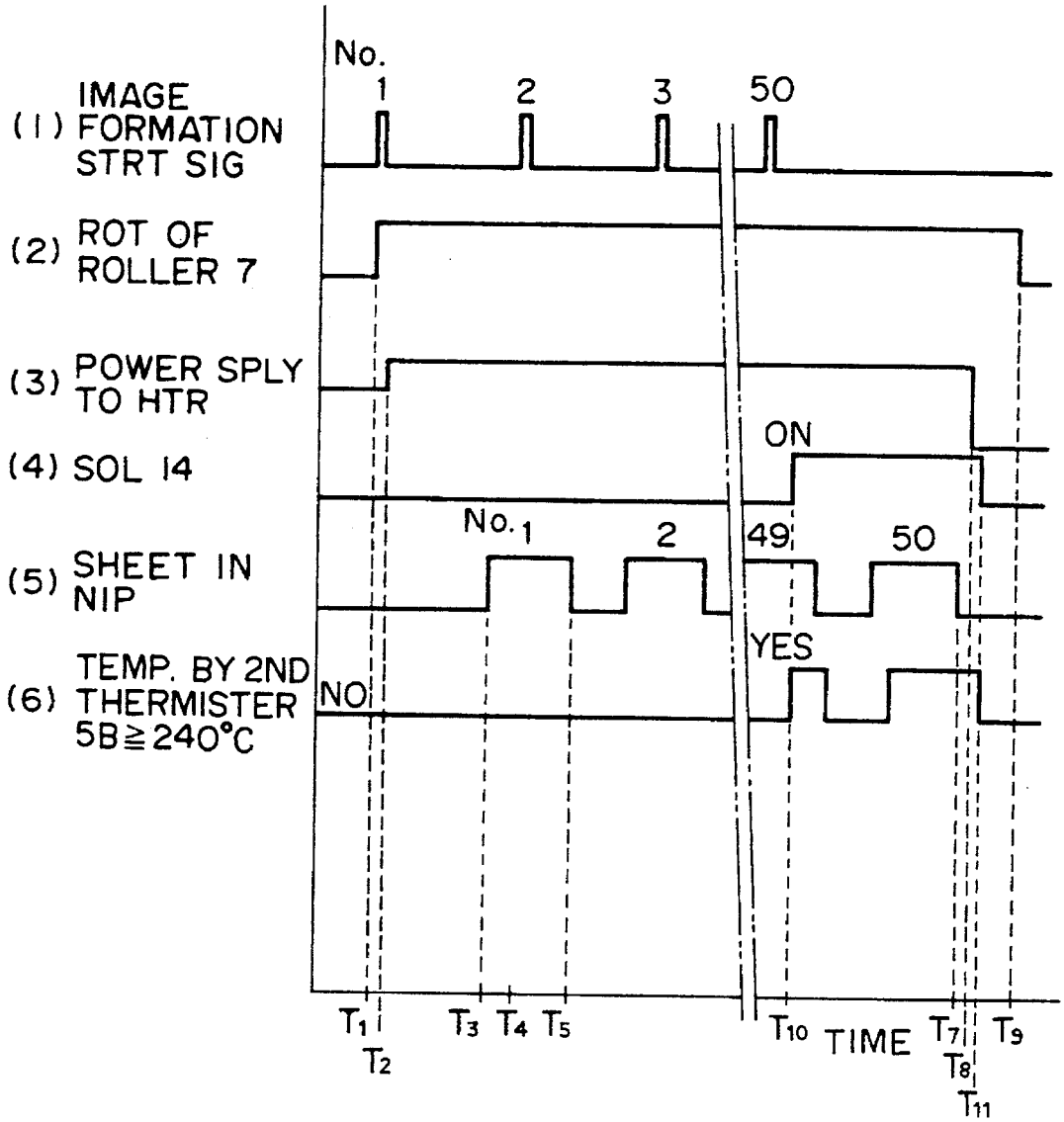
FIG. 8 is an operational timing chart for the cleaning roller in the fourth embodiment of the present invention.

As shown in FIG. 8, as soon as the temperature $T_{5B}$ detected by the second thermistor 5B comes to satisfy: $T_{5B} \geqq 240°$ C., the solenoid 14 is activated to move the cleaning roller away from the pressure roller.

The toner employed in this embodiment was a type which melted at approximately 220° C., its viscosity becoming excessively low, which caused so-called high temperature off-set. However, when the temperature $T_{5B}$ detected by the second thermistor was 240° C., the surface temperature of the pressure roller 9 was 210° C. where the temperature was highest, which was lower than the aforementioned temperature at which the high temperature off-set occurred.

In this embodiment, when the small size recording materials were consecutively fed, the temperature $T_{5B}$ detected by the second thermistor came to satisfy: $T_{5B} \geqq 240°$ C., at a time $T_{10}$ while the 49th sheet was passed, due to the excessive temperature increase at the non-sheet passage portion. At this time, the solenoid 14 was activated to separate the cleaning roller from the pressure roller, when the highest temperature across the heater surface was still less than 210° C.; therefore, the contamination on the cleaning roller surface did not migrate back to the pressure roller. At a time $T_{11}$ when the temperature $T_{5B}$ came to satisfy: $T_{5B} < 240°$ C., the solenoid was again deactivated, and thereafter, the cleaning roller remained in contact with the pressure roller, cleaning the pressure roller surface as it was rotated by the pressure roller.

According to this embodiment, the cleaning roller does not come in contact with the pressure roller when the pressure roller temperature is excessively high; therefore, the contamination such as the toner or the like on the cleaning roller surface can be prevented from re-melting or re-softening and migrating back to the pressure roller, and then, to the recording material to which it finally adheres.

Embodiment 5

Next, referring to FIG. 9, the fifth embodiment of the present invention will be described. The same components as those in Embodiment 1 will be designated by the same reference numerals and their description will be omitted.

Figure 9:
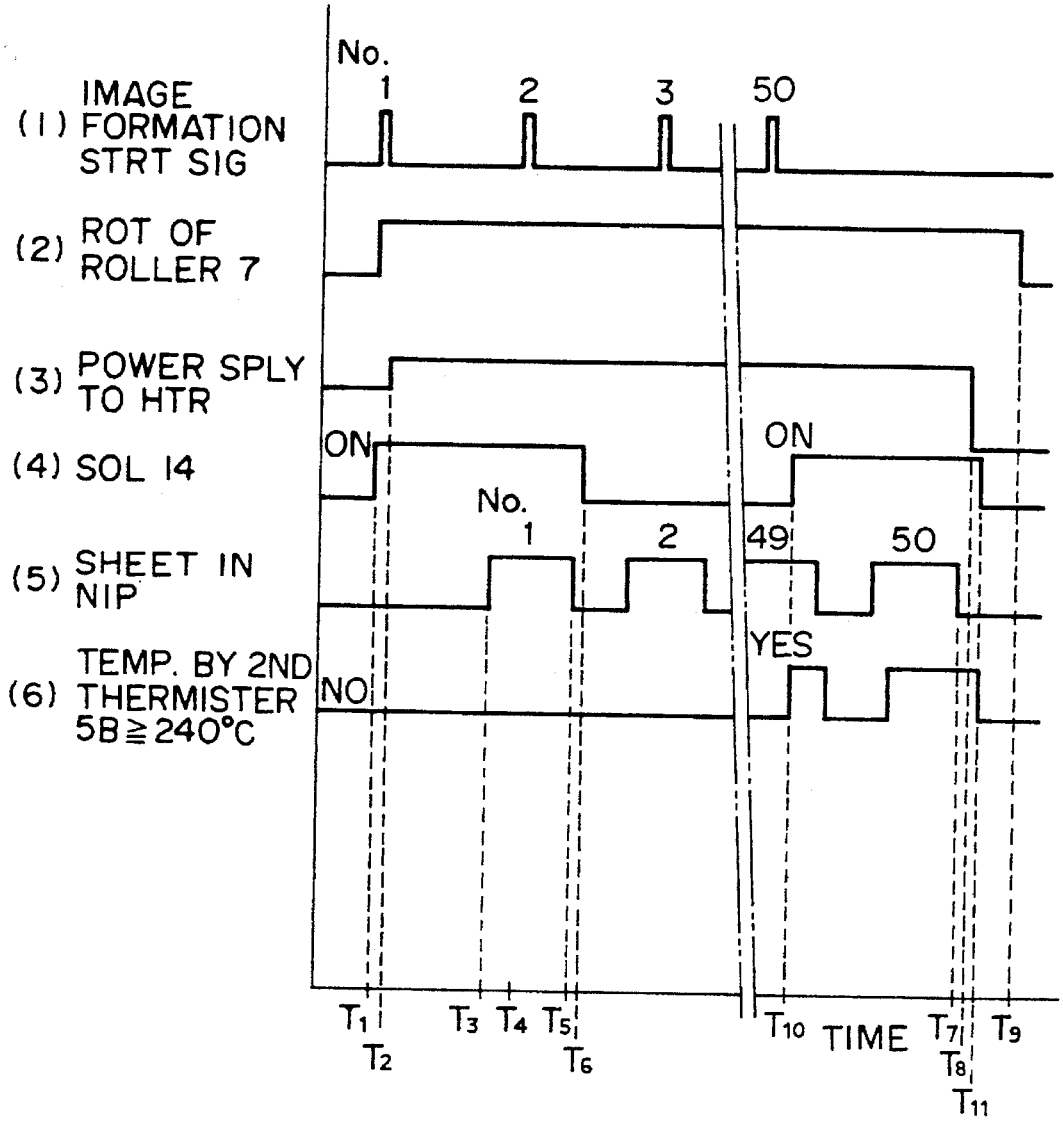
FIG. 9 is an operational timing chart for the cleaning roller in the fifth embodiment of the present invention.

FIG. 9 is a timing chart for this embodiment. The solenoid 14 is activated or deactivated with the same timing as Embodiment 1 until the second recording material enters the nip after the image formation start signal is issued at a time $T_1$, and thereafter, the same timing as Embodiment 7 is adopted.

According to this embodiment, a first sheet can be excellently fixed while preventing the contamination on the cleaning roller surface from migrating back to the pressure roller when the temperature is excessively high at the non-sheet passage portion.

Embodiment 6

Next, referring to FIG. 10, the sixth embodiment of the present invention will be described. The same components as those in Embodiment 1 will be designated by the same reference numerals and their description will be omitted.

Figure 10:
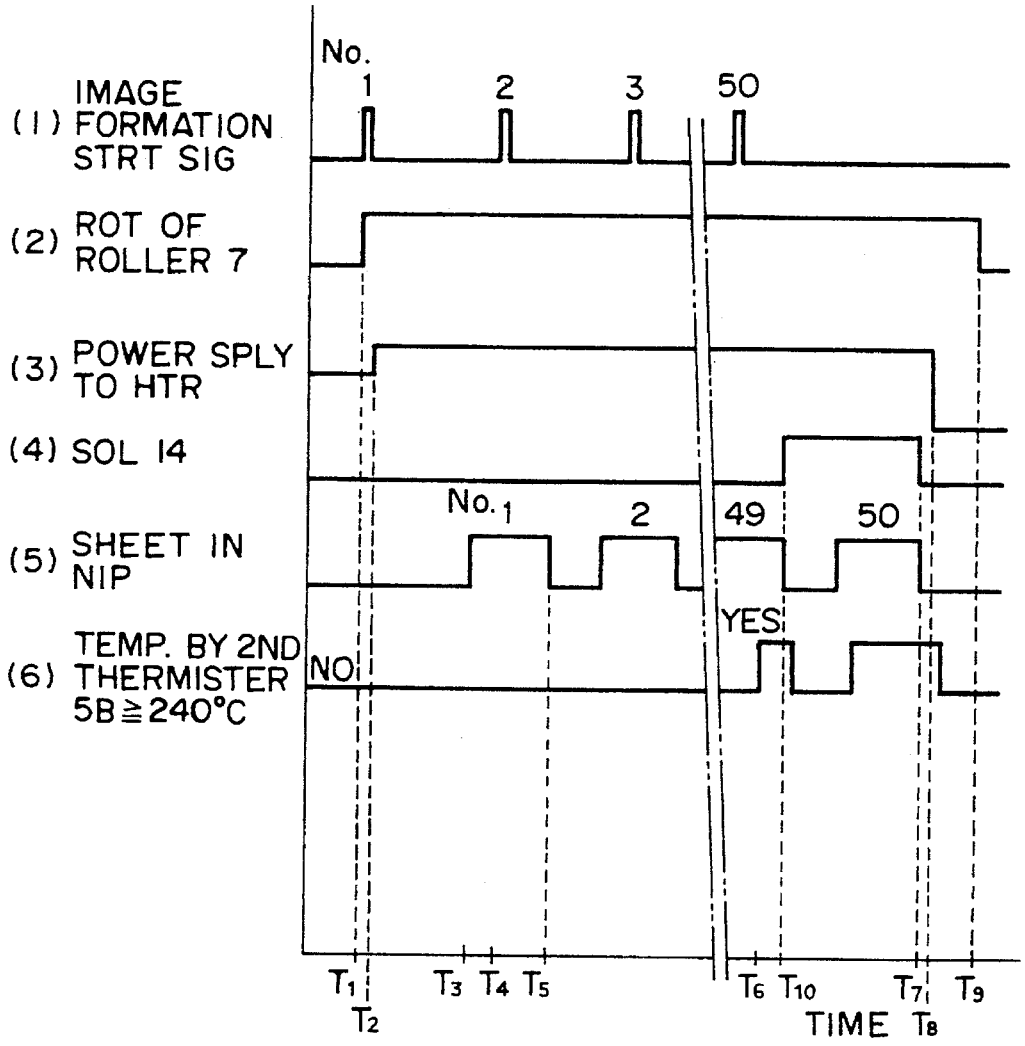
FIG. 10 is an operational timing chart for the cleaning roller in the sixth embodiment of the present invention.

As shown in FIG. 10, the cleaning roller is not going to be separated from the pressure roller immediately after the temperature $T_{5B}$ comes to satisfy: $T_{5B} \geqq 240°$ C., but instead, it is separated from the pressure roller after the recording material undergoing the fixing precess comes out of the fixing nip, and it may be again placed in contact with the pressure roller as soon as the last recording material comes out of the fixing nip.

According to this embodiment, the heat radiation from the pressure roller can be kept constant during the fixing process; therefore, a stable fixing performance can be assured.

Embodiment 7

Next, the seventh embodiment of the present invention will be described. The same components as those in the first embodiment will be designated by the same reference numerals and their description will be omitted.

The cleaning roller is made of an aluminum rod. According to this embodiment, the heat conductance of the cleaning roller is larger than that in Embodiment 1; therefore, the excessive temperature increase which occurs at the non-sheet passage portion while the small size recording materials are consecutively fed is less likely to occur.

In this case, the effectiveness of this embodiment in impeding the excessive temperature increase at the non-sheet passage was more evident when the thermal conductivity W ($W \cdot m^{-1} \cdot K^{-1}$) of the cleaning roller satisfied: $W \geqq 1.0$. Now, the thermal conductivities for the materials formable as the cleaning roller are listed below.

1) Pyrex glass: W=1.1, more preferably: $W \geqq 10$

2) Stainless steel: W=15

3) Aluminum: W=240

Embodiment 8

In this embodiment, the cleaning roller used in Embodiment 1 or 2 is impregnated with a separative agent. According to this embodiment, the pressure roller can be more effectively prevented from being contaminated.

Embodiment 9

Next, referring to FIGS. 11 to 15, the ninth embodiment of the present invention will be described. FIG. 1 is a sectional view of one of the embodiments of the present invention, that is, a fixing apparatus adopting a through-film heating system using a tensionless film, showing its general structure.

Figure 11:
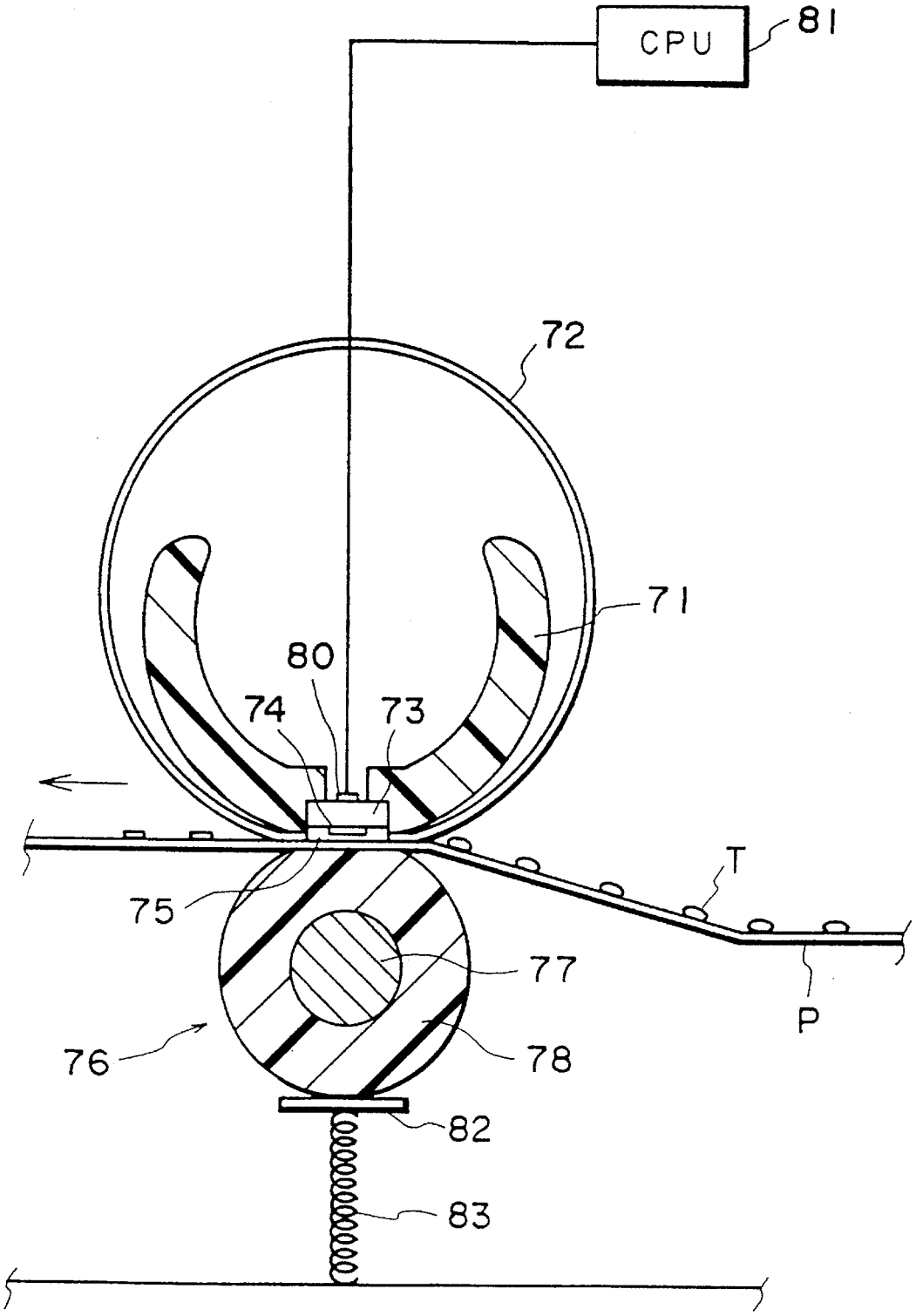
FIG. 11 is a sectional view of the general structure of an embodiment of the thermal fixing apparatus in accordance with the present invention.
Figure 12:
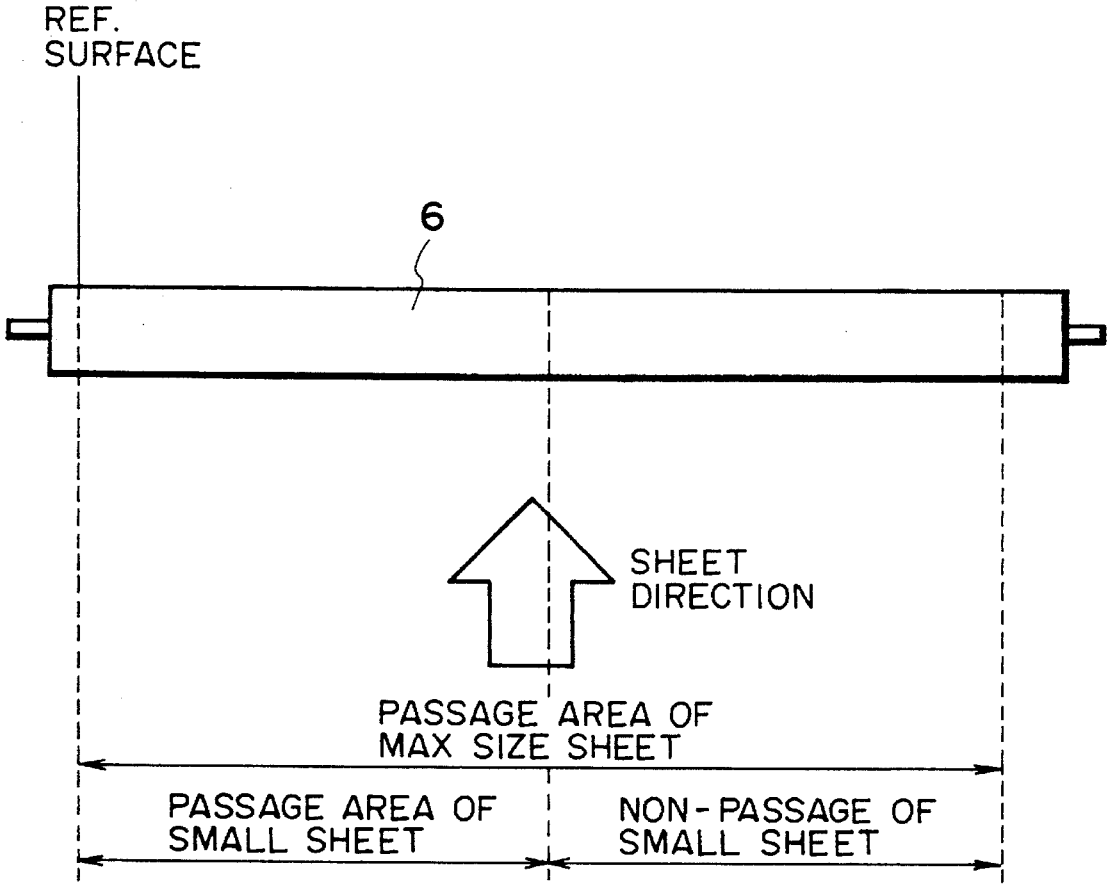
FIG. 12 is a schematic showing the sheet passage area and non-sheet passage area in the apparatus shown in FIG. 11.

In FIG. 11, a reference numeral 71 designates a resin stay elongated perpendicular to the direction in which the recording material is conveyed, and this resin stay 71 functions as a guide member for guiding the internal surface of a film 72 which will be described later.

The film 72 is a heat resistant endless film, and is fitted around the stay 71 in such a manner that a certain length of its internal surface remains in contact with the stay 71 which embraces the heater 73 as the heating member. The internal peripheral surface length of this heat resistant endless film 72 is made longer than the external peripheral surface length of the stay 71 embracing the heater 73, by 3 mm, for example; therefore, the film 72 loosely fits around the stay 1 embracing the heater 73, with some room to spare.

In order to reduce the thermal capacity of the film 72 so that the warmup time is reduced, the overall film thickness of the film 72 is made to be less than 100 μm. As for the material for the film 72, a monolayer film of PTFE, PFA, or PEP, which is heat resistant, separative, strong, and durable, may be used, as well as a multilayer film comprising a base film of polyimide, polyamide imide, PEEK, PES, or PPS, and a layer of PTFE, PFA, or FEP, being coated on the external peripheral surface the base film. In this embodiment, a multilayer film made by coating the external peripheral surface of an endless polyimide film with PTFE is used. Its overall thickness is 50 μm.

A reference numeral 73 designates a heater as the heating member. The heater 73 comprises a substrate of alumina or the like, a heat generating member 74, and a protective layer 75, wherein the heat generating member 74 is formed by coating, through the screen-printing process or the like, an electrically resistive material such as Ag/Pd on the substrate, approximately 10 mm thick and 1 to 3 mm wide, along the substantial center line in the longitudinal direction of the substrate, and the protective layer 75 is a coated layer of glass, fluorinated resin, or the like.

Further, a reference numeral 80 designates a thermistor for the heating member. This heating member thermistor 80 is positioned on the heater 73, on the side opposite to the one which remains in contact with the fixing film. The temperature of the heater 73 is controlled in response to the temperature detected by the thermistor 80. Also, in order to stabilize the fixing performance, the thermistor 80 is positioned adjacent to the sheet alignment reference member, so that the temperature control of the heater is always executed on the portion within the sheet passage.

A reference numeral 76 designates a film pressing roller, which is a rotary member for driving the film 72, and coordinates with the heater 73 to form the fixing nip, with the film 72 being interposed. The pressure roller 76 comprises a stainless steel shaft 77 measuring 8 mm in the external diameter and a silicon rubber roller portion 78 measuring 220 mm in length and approximately 4 mm in thickness, and is driven by an unshown driving means by way of the end portion(s) of the stainless steel shaft 77. The peripheral surface of the roller portion 78 is a baked coating of 30 μm thick fluorinated latex coat (mixture of GLS 213, product of Daikin, and FEP by 10 wt %). Its hardness is 50° C. (Asker C).

A reference numeral 82 designates a heat conducting plate member for improving the heat conductivity in the longitudinal direction of the pressure roller, so that the temperature difference is reduced between the sheet passage portion and the non-sheet passage portion, and is pressed on the pressure roller by a spring 83. In this embodiment, an aluminum plate, which is excellent in heat conductivity, is used as the heat conducting plate member 82. It is shaped 1.5 mm thick, 20 mm wide, and 220 mm long, in consideration of effectiveness, space, cost, and the like factors, and is placed in contact with the pressure roller across the entire length.

Further, in the fixing apparatus of this embodiment, a sheet alignment reference member is provided on only one lateral side, and the recording materials are conveyed with one of their lateral sides being aligned with the alignment reference member (a), regardless of their sizes.

Figure 13:
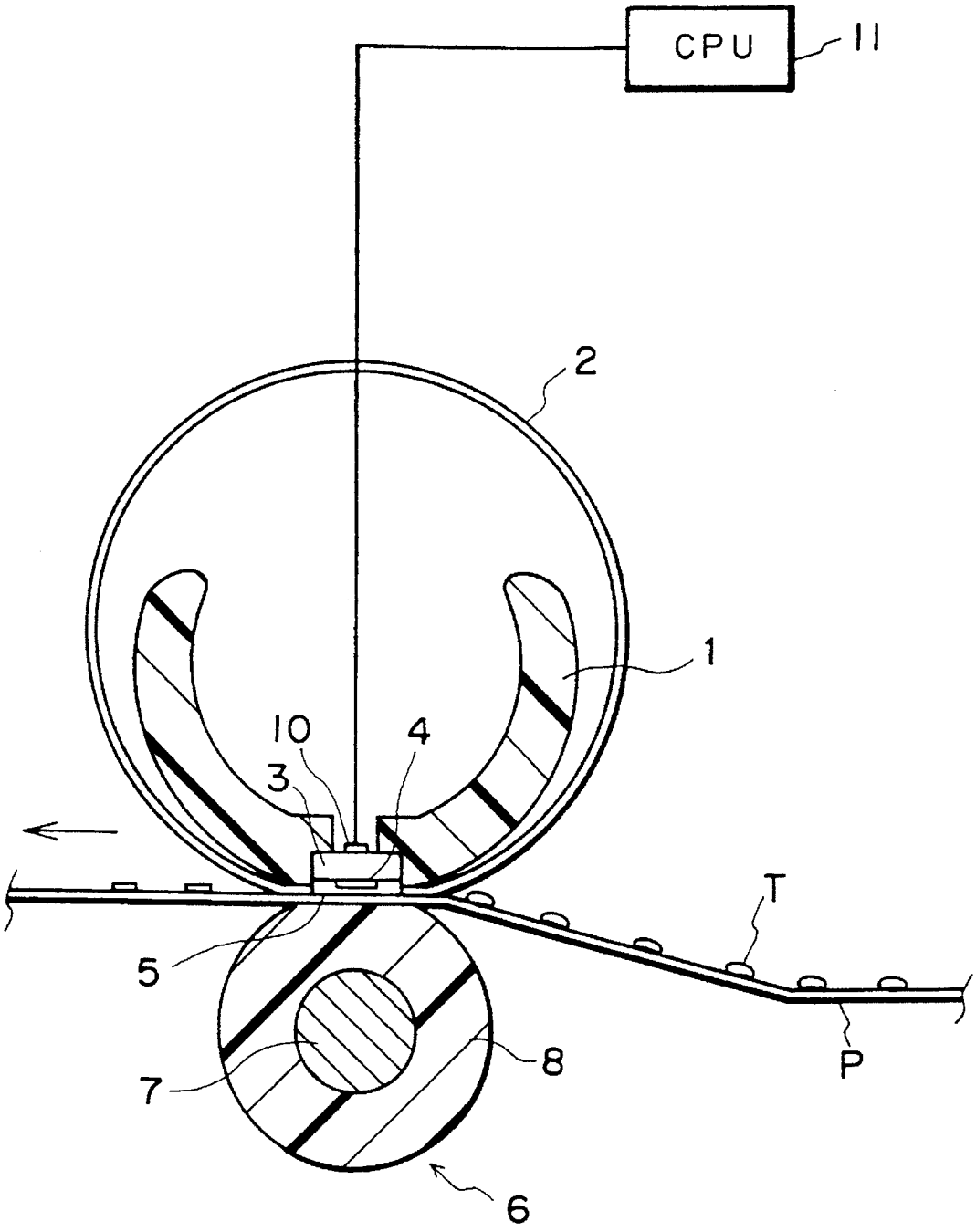
FIG. 13 is a sectional view of the thermal fixing apparatus to be compared to the ninth embodiment of the present invention.

A fixing apparatus of this embodiment structured as described in the foregoing, and a fixing apparatus shown in FIG. 13, which had the same structure as this embodiment, except for the heat conducting plate member 82 and the spring 83, were subjected to a test, in which the temperature increase in the pressure roller and the degree of film distortion were measured.

Figure 14:
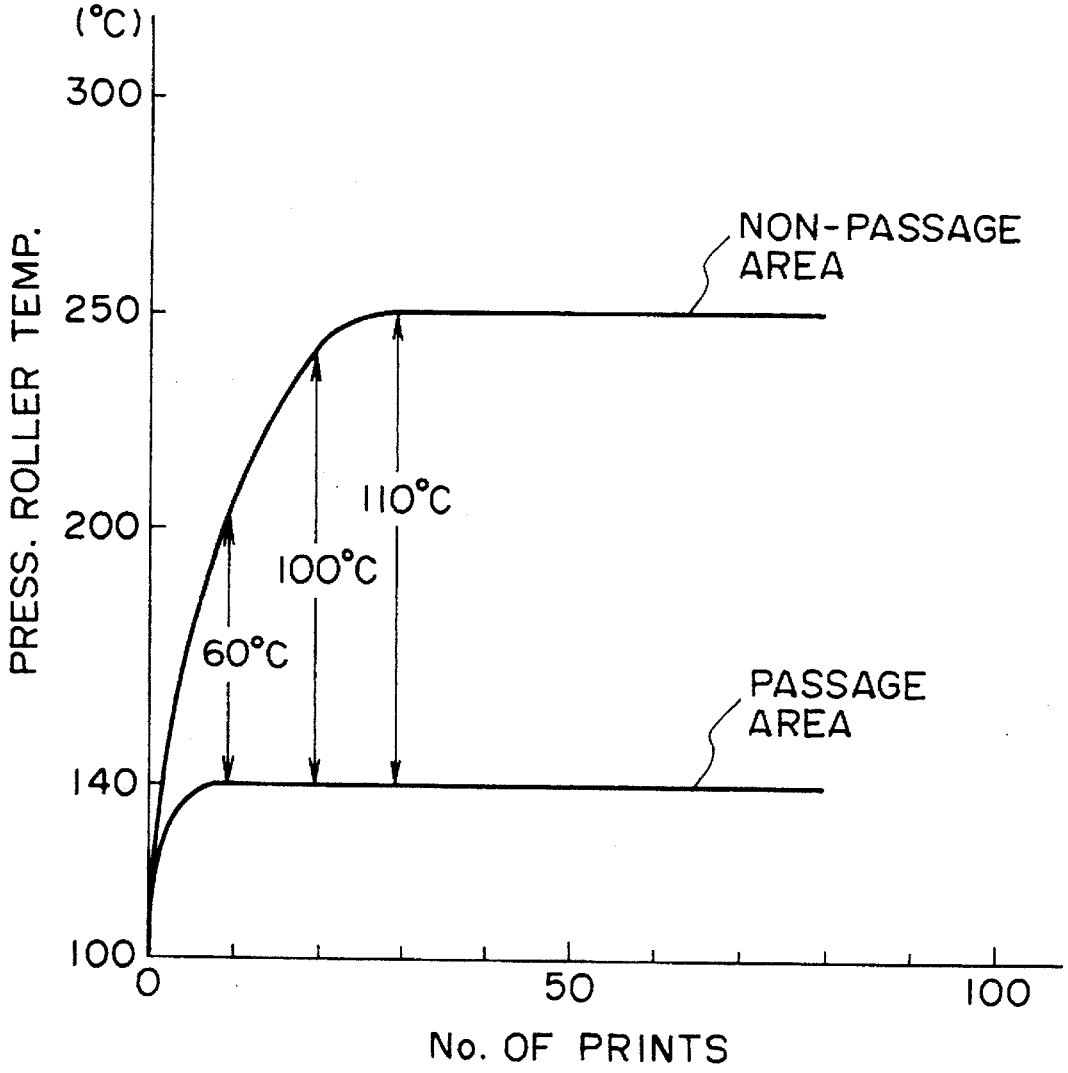
FIG. 14 is a graph of the pressure roller temperature when small size recording sheets are consecutively fed while the apparatus shown in FIG. 13 is in use.
Figure 15:
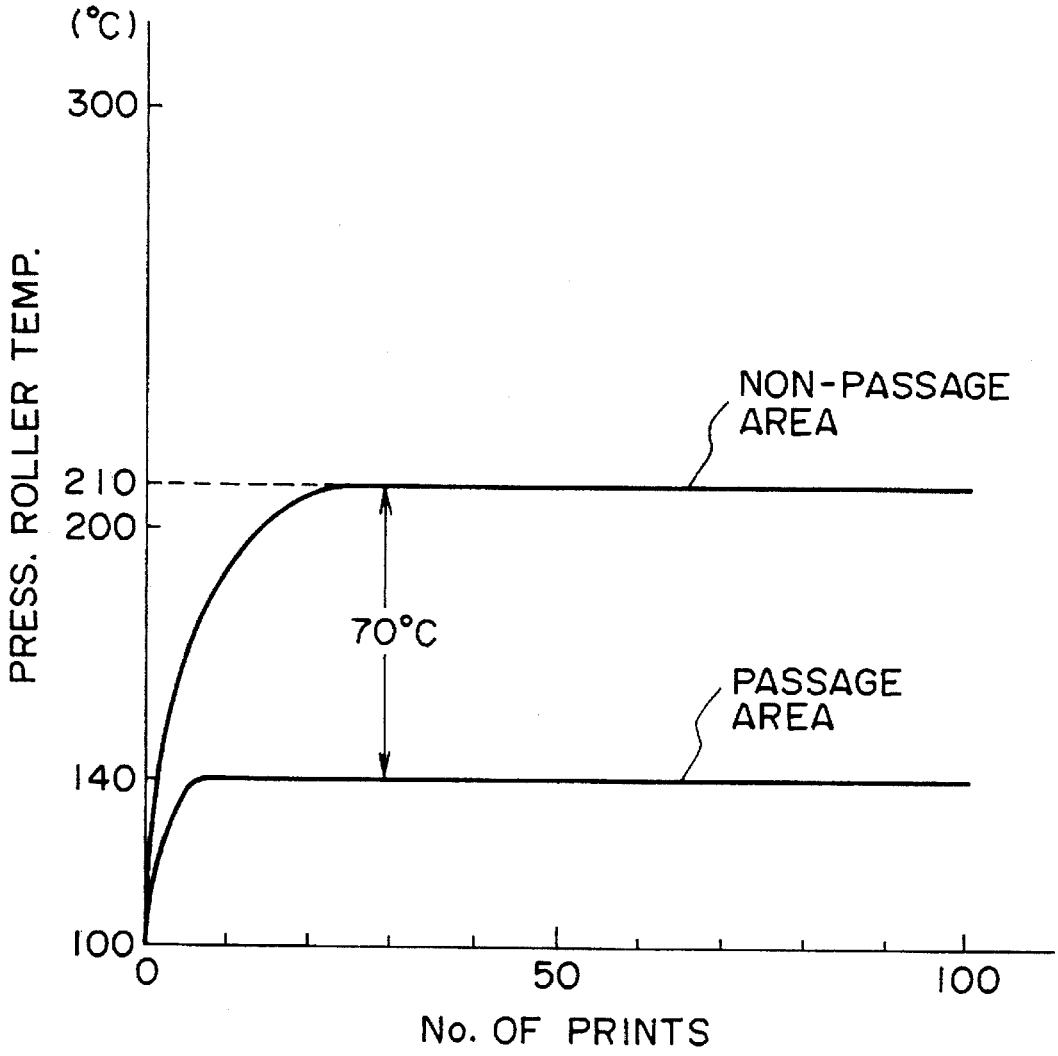
FIG. 15 is a graph of the pressure roller temperature when small size recording sheets are consecutively fed while the apparatus shown in FIG. 11 is in use.

FIG. 14 shows the results of the test conducted using the fixing apparatus shown in FIG. 13, in which the temperature of the pressure roller 76 was measured using thermography (Thermotracer, product of NICHIDEN SANEI, Japan) at both the sheet passage portion and the non-sheet passage portion, while the temperature of the heater 73 was controlled to be 160° C.; a number of envelopes (105 mm×241 mm), which gave the excessive temperature increase at the non-sheet passage portion, were consecutively fed, at a process speed (sheet conveying speed) of 24 mm/sec, with sheet intervals of 150 mm. As is evident from this graph, the temperature difference on the pressure roller reached approximately 60° C. after processing 10 sheets, and increased to 100° C. after 20 sheets. In the tests conducted by the inventors of the present invention, when the temperature difference between the sheet passage and non-sheet passage portions of the pressure roller became more than 100° C., wrinkles began to appear on the film 2, causing thereby the film to distort.

Next, the results of another test which was conducted using the fixing apparatus in accordance with this embodiment will be discussed referring to FIG. 5. As is evident from the graph, the temperature difference between the sheet passage and non-sheet passage portions of the pressure roller 76 was approximately 70° C. after 30 sheets were consecutively fed, and the distortion of the film did not occur even after 100 sheets were consecutively fed. This fact suggests that the reason why the excessive temperature increase at the non-sheet passage could be impeded as shown in the test is because the surplus thermal energy which otherwise might have been accumulated in the pressure roller, on the non-sheet passage side from which the heat is not robbed by the recording material, was conducted to the sheet passage side by the aluminum plate 82 placed in contact with the pressure roller 76.

Further, the results were also effected by the heat radiation by this aluminum plate 82 itself. When the temperature of the aluminum plate was measured after more than 30 envelops were actually fed, it was 200° C. on the non-sheet passage side, and 150° C. on the sheet passage side. In other words, on the sheet passage side, the temperature of the aluminum plate 82 was higher than that of the pressure roller, which implies that the surplus heat energy accumulated in the non-sheet passage side of the pressure roller was conducted to the sheet passage side of the pressure roller through the aluminum plate 82.

As described in the foregoing, when the surplus thermal energy in the non-sheet passage portion of the pressure roller is transferred to the sheet passage portion, the temperature detected by the thermistor 80 positioned within the sheet passage drops less, whereby the heater under the temperature control is less frequently turned on or off, reducing thereby the amount of excessive temperature increase at the non-sheet passage portion.

As the main factors which are thought to cause the film distortion, there are thermal expansion of the pressure roller, film dimension (film thickness or the like) related to the film distortion, and film surface (inward facing surface) properties (friction coefficient change or the like). These factors are all temperature dependent. Among these factors, the thermal expansion of the pressure roller is approximately 600 μm in the external diameter change when the temperature difference is 100° C., and it has been discovered through studies by the inventors of the present invention that the resistance to the film distortion caused by the excessive temperature increase on the non-sheet passage portion of the pressure roller can be increased by increasing the thickness of the film.

It has not been found out in detail how these factors affects the film distortion, but it has been known that reducing the pressure roller temperature at the non-sheet passage portion, or reducing the film temperature, is very effective for preventing the occurrence of the film distortion.

As is evident from the foregoing, when the fixing apparatus has the structure in accordance with this embodiment, the occurrence of the film distortion can be prevented, whereby it becomes possible to prevent the fixing failure, the sheet feeding failure, and also, the damage to the fixing apparatus itself such as severed film, which are all caused by the film distortion. Further, the surface layer of the pressure roller is formed of a 30 μm thick baked coating of fluorinated latex (FEP is mixed in GLS 213, product of Daikin, by 10 wt %), and it can withstand a temperature range as high as 250° C. to 260° C. Therefore, it is necessary to keep the temperature at the non-sheet passage portion below 250° C. In the case of the fixing apparatus according to the present invention, the temperature at the non-sheet passage portion is approximately 210° C.; therefore, the damage to the pressure roller can be prevented.

Embodiment 10

Next, referring to FIGS. 16 and 17, the tenth embodiment of the present invention will be described. The same components as those in Embodiment 9 are designated by the same reference numerals and their descriptions are omitted.

In order to extend the service life of the apparatus which might be reduced by the damage to the pressure roller or the contamination of the pressure roller, and also, in order to reduce the unnecessary temperature increase in the non-sheet passage portion of the pressure roller, a cylindrical metallic roller as a heat conducting member is placed in contact with the pressure roller. FIG. 16 is a sectional view of the fixing apparatus according to this embodiment, depicting the general structure.

Figure 16:
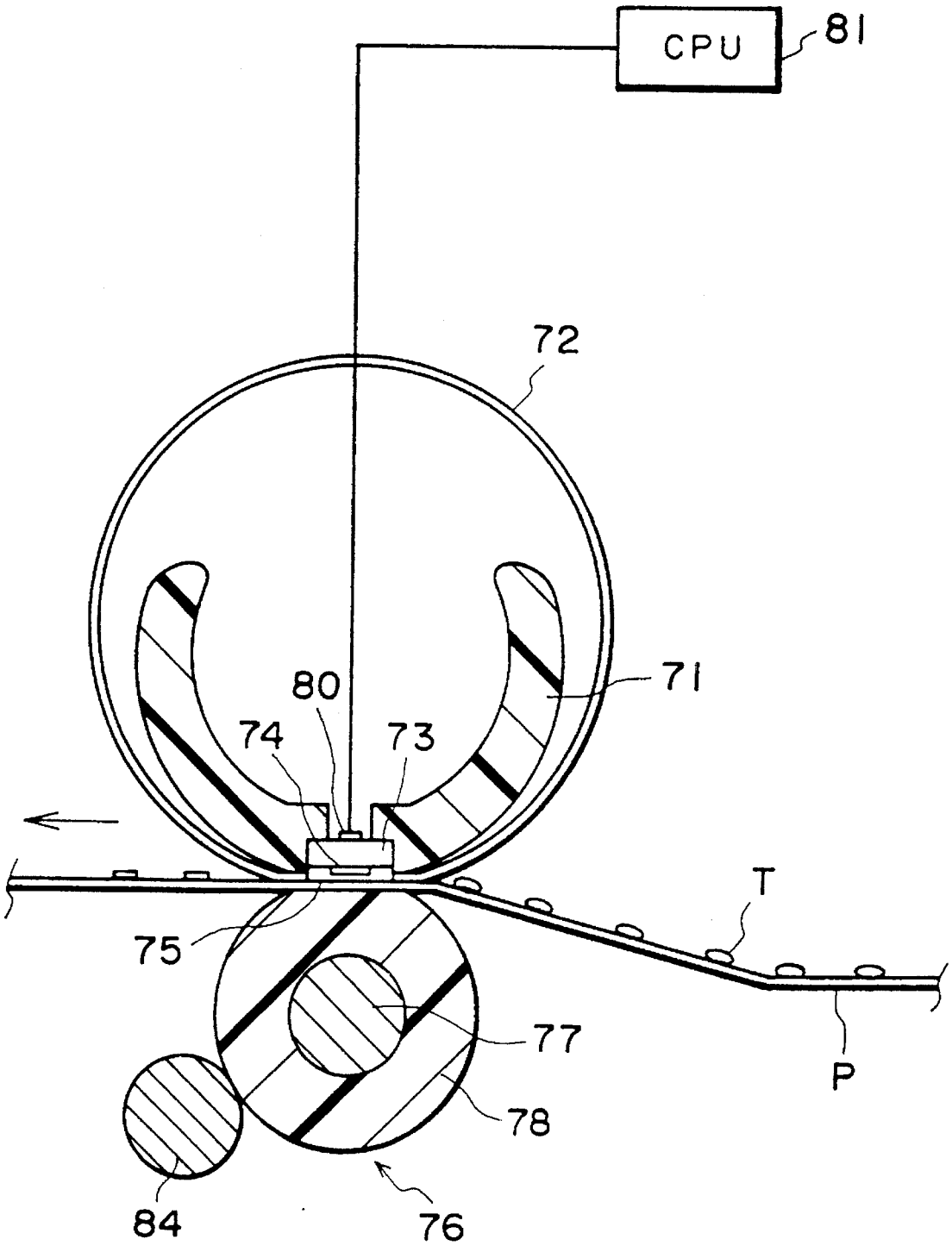
FIG. 16 is a sectional view of the general structure of the tenth embodiment of the thermal fixing apparatus in accordance with the present invention.
Figure 17:
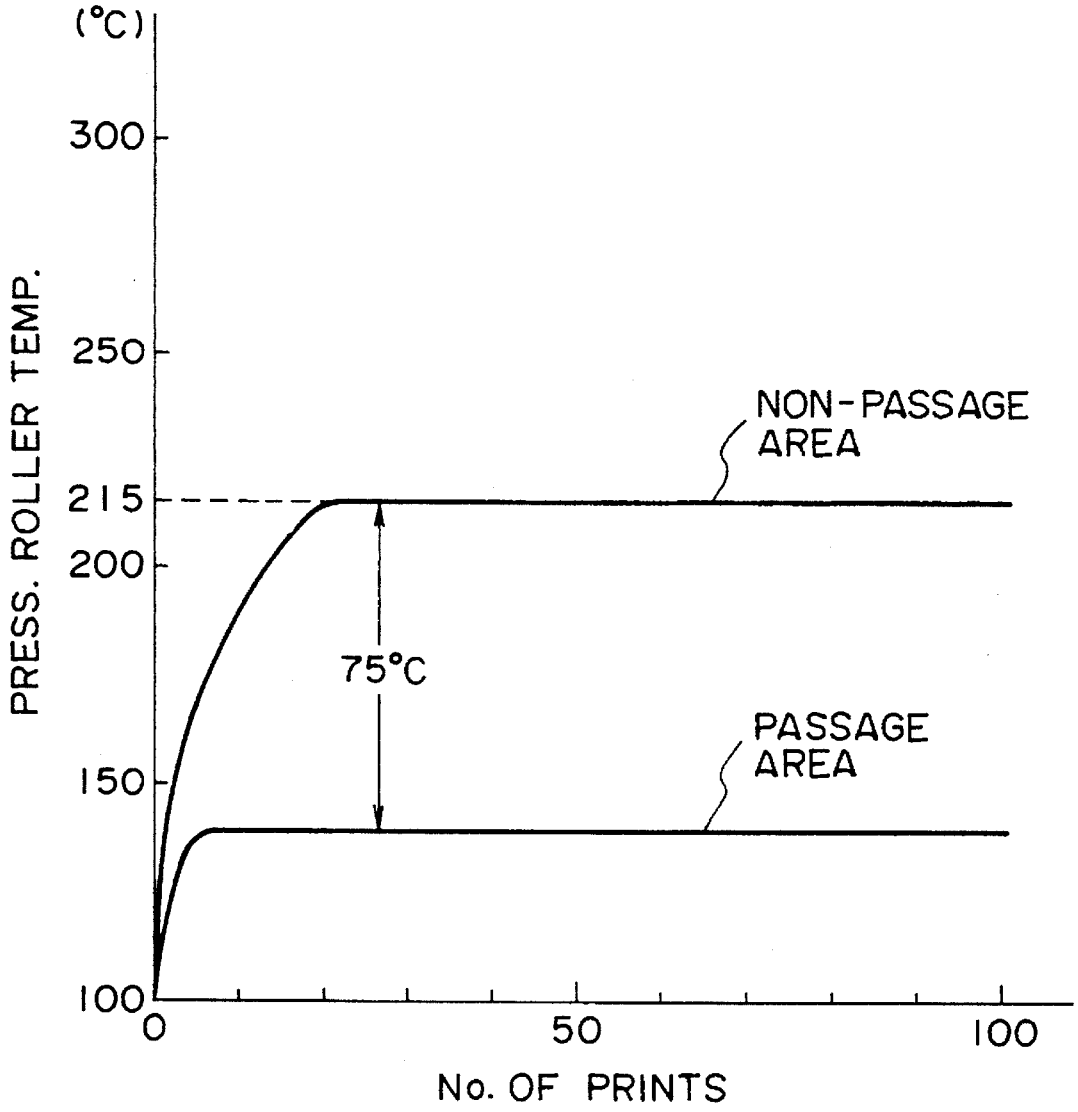
FIG. 17 is a graph of the pressure roller temperature when small size recording sheets are consecutively fed while the apparatus shown in FIG. 16 is in use.

In FIG. 16, a reference numeral 84 designates the metallic roller being in contact with the pressure roller 76, and in this embodiment, it is made of aluminum, which has excellent heat conductivity. It is formed as an aluminum roller measuring 6 mm in the external diameter and 220 mm in length, in consideration of the effect, space, cost, or the like, and is placed in contact with the pressure roller, across the entire length. The fixing apparatus according to this embodiment has the same structure as the one shown in FIG. 11, except for the metallic (aluminum) roller 84.

A test was conducted using the fixing apparatus according to this embodiment, in which the temperature increase of the pressure roller was measured and the distortion of the film was observed. FIG. 17 shows the results of the test in which the pressure roller temperature was measured using thermography, at the sheet passage portion and the non-sheet passage portion, while the temperature of the heater 73 was controlled to be 160° C., and a number of envelopes, which caused the excessive temperature increase on the non-sheet passage portion, were consecutively fed, at a processing speed of 24 mm/sec, with sheet intervals of 150 mm.

As is evident from this graph, the temperature difference between the sheet passage and non-sheet passage portions of the pressure roller was approximately 75° C. after more than 30 sheets were consecutively fed, and the film distortion did not occur even after 100 sheets were consecutively fed. It is conceivable that this is because the surplus thermal energy accumulated in the non-sheet passage portion was conducted to the sheet passage portion by the aluminum roller 84 placed in contact with the pressure roller 76, and because of the effect of the heat radiation of the aluminum roller 84 itself.

Next, the fixing apparatus according to this embodiment and the fixing apparatus according to Embodiment 9 were tested with regard to the damage to the pressure roller and the contamination of the pressure roller, which were caused through usage. In the case of the fixing apparatus according to Embodiment 9, the contamination appeared after 100 plain sheets were consecutively fed, and damage appeared after 50,000 sheets. On the contrary, in the case of the fixing apparatus according to this embodiment, no damage was observed even after consecutive feeding of 100,000 sheets. This is because in the fixing apparatus according to Embodiment 9, the aluminum plate 82 is in contact with the pressure roller 76, but in the fixing apparatus according to this embodiment, the aluminum roller 74 which is rotary member is in contact with the pressure roller 76, improving thereby the durability of the pressure roller 76.

As was described in the foregoing, with the fixing apparatus according to this embodiment, the occurrence of the film distortion can be prevented, which in turn prevents the fixing failure, the sheet feeding failure, and also, the damage to the fixing apparatus such as the severed film. Further, it is possible to keep the temperature of the non-sheet passage portion of the pressure roller below 250° C., which is the maximum temperature tolerated by the fluorinated latex surface layer of the pressure roller, thus the pressure roller is prevented from being damaged. Further, in the fixing apparatus according to this embodiment, the aluminum roller which is a rotary member is placed in contact with the pressure roller; therefore, the durability of the pressure roller is improved.

Embodiment 11

Next, referring to FIGS. 18 and 19, the eleventh embodiment of the present invention will be described. The same components as those in Embodiment 9 are designated by the same reference numerals and their descriptions are omitted.

In the fixing apparatus according to this embodiment, in order to prevent the excessive temperature increase at the non-sheet passage portion of the pressure roller, and to eliminate entirely the occurrence of damage to the pressure roller, the contamination of the pressure roller, or the like, which has been the shortcomings of the preceding embodiments, a non-contact heat conductor member is provided for the pressure roller. FIG. 18 is a sectional view of the fixing apparatus according to this embodiment, depicting the general structure.

Figure 18:
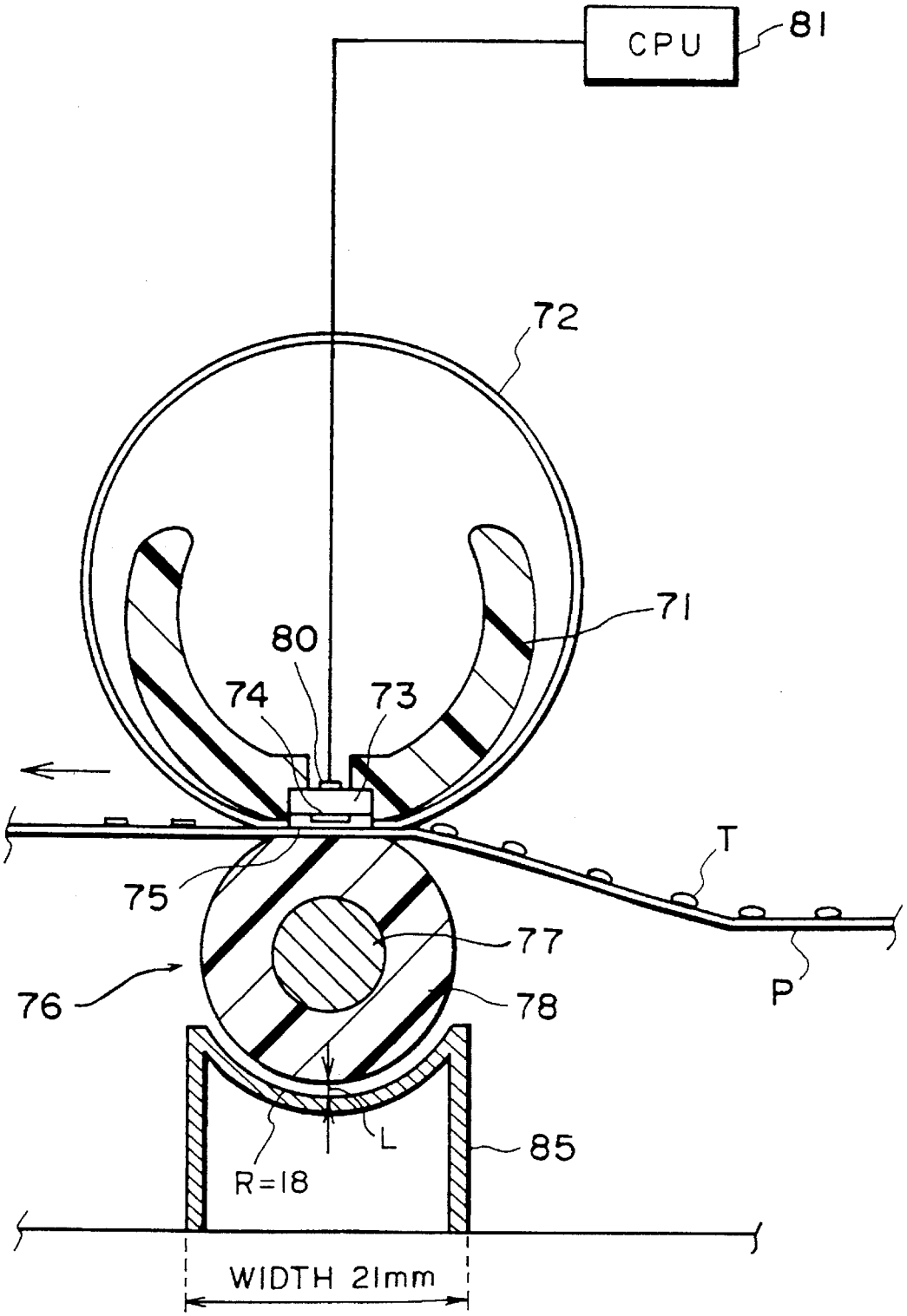
FIG. 18 is a sectional view of the general structure of the eleventh embodiment of the thermal fixing apparatus in accordance with the present invention.
Figure 19:
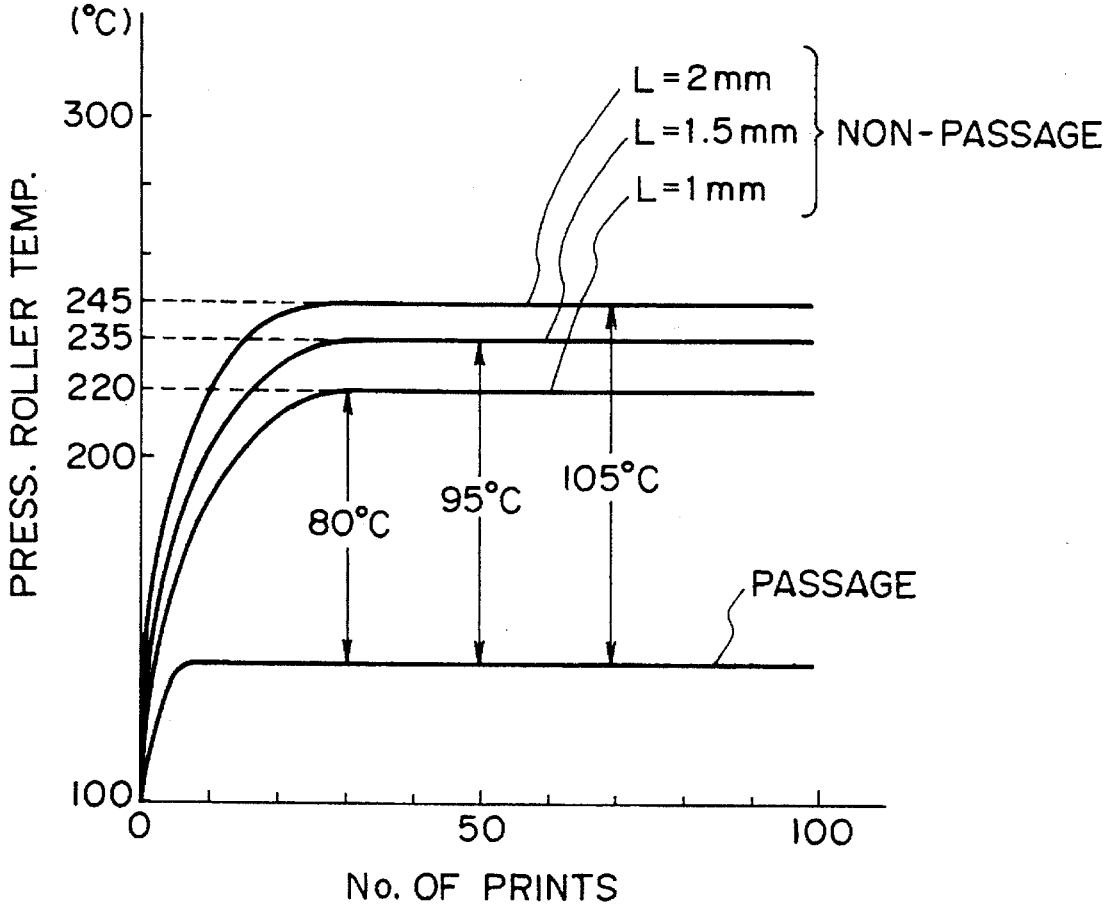
FIG. 19 is a graph of the pressure roller temperature when small size recording sheets are consecutively fed while the apparatus shown in FIG. 18 is in use.

In FIG. 18, a reference numeral 85 designates the heat conducting member, which is positioned adjacent to the pressure roller 76, holding a predetermined distance, to conduct the surplus heat from the non-sheet passage portion of the pressure roller. In this embodiment, it is made of aluminum, which has excellent conductivity. In consideration of the effect, space, cost, or the like factor, its dimension is set to be 1.5 mm thick, 220 mm long, and 18 mm in the curvature of the surface facing the pressure roller, and it is arranged in such a manner that it can cover ⅓ of the pressure roller surface. Here, a gap L between the heat conducting member 85 and the pressure roller 86 is 1 mm. The structure of this embodiment is the same as that in the fixing apparatus shown in FIG. 11, except for the heat conducting member 85.

The fixing apparatus according to this embodiment (gap L=1 mm) and other fixing apparatuses with the same structure, except for the gap L, in which the gaps L was set at 1.5 mm and 2.0 mm, were tested with regard to the temperature increase of the pressure roller and the film distortion. In the test, the heater temperature was controlled to be 160° C.; the gap L between the pressure roller 76 and the heat conducting member 85 was set at 1 mm, 1.5 mm, and 2 mm, in the fixing apparatus having the same structure as the fixing apparatus according to this embodiment, except for the gap L: and a number of envelopes (105 mm×241 mm) which caused excessive temperature increase at the non-sheet passage portion were consecutively fed, at a process speed (conveying speed) of 24 mm/sec, with sheet intervals of 150 mm. FIG. 19 is a graph showing the pressure roller temperature, at the sheet passage and non-sheet passage portions, measured in the test by thermography.

In this test, in the case of the fixing apparatus with a gap L of 2 mm, the film became distorted after consecutive feeding of 25 sheets, and at this time, the temperature difference between the sheet passage and non-sheet passage portions of the pressure roller was approximately 100° C.; in the case of the fixing apparatus with a gap L of 1.5 mm, the film began to be distorted several times, generating crackling sounds, and recovered afterward, during consecutive feeding of 100 sheets. At this time, the temperature difference between the sheet passage and non-sheet passage portions of the pressure roller was approximately 95° C. In the case of the fixing apparatus with a gap L of 1 mm, the temperature difference across the pressure roller was approximately 80° C. even after consecutive feeding of 100 sheets, and no film distortion occurred. These findings suggest that it is preferable for the gap L between the pressure roller 76 and the heat conducting member 85 to be set to be less than 1 mm, and in consideration of the thermal expansion of the pressure roller and the mechanical tolerance, the gap L for this embodiment was set up to be 1 mm. It is conceivable that by setting up the gap L to be 1 mm, the surplus thermal energy accumulated in the non-sheet passage portion of the pressure roller 76 was conducted to the sheet passage portion, and the effect of the heat radiation of the heat conducting member 85 itself was apparently displayed.

As was described in the foregoing, by using the fixing apparatus according to this embodiment, the occurrence of the film distortion can be prevented, whereby the fixing failure, the sheet feeding failure, and also, the damage to the fixing apparatus such as the severed film, which are all caused by the distortion of the film, can be prevented. Further, it is possible to keep the temperature of the pressure roller, at the non-sheet passage portion, below 250° C., which is the maximum tolerable temperature for the fluorinated latex coat surface layer of the pressure roller; therefore, the damage to the pressure roller can be prevented. Further, in the fixing apparatus according to this embodiment, the non-contact heat conducting member is provided for the pressure roller; therefore, there is no need to fear that the durability of the pressure roller will be deteriorated by the provision of the heat conducting member.

Further, in the embodiments described so far, a piece of film and a heater on which the film slides were employed. However, a heat generating layer such as the heater may be formed on the film itself to heat the image. Further, the image forming apparatus according to the present invention can be used not only as the fixing apparatus but also as the apparatus for altering the surface properties of the image.

While the invention has been described with reference to the structure disclosed therein, it is not confined to the details set forth, and this application is intended to cover such modifications or changes as may come within the purposes of the improvements or the scope of the following claims.

What is claim is:

1. An image heating apparatus comprising:

a heater;

a film for transferring the heat from said heater to an image on a recording material;

a rotary backup member for forming a nip with said film;

a cleaning member for cleaning a peripheral surface of said rotary backup member;

moving means for moving said cleaning member so that it comes in contact with, or moves away from, the surface of said rotary backup member;

wherein said moving means places said cleaning member in contact with the surface of said rotary backup member after a temperature of said rotary backup member increases.

2. An image heating apparatus according to claim 1, wherein during a continuous operation, said moving means places said cleaning member in contact with the surface of said rotary backup member after the image heating cycle is repeated a predetermined number of times.

3. An image heating apparatus according to claim 1, wherein said apparatus further comprises a temperature detecting member for detecting a temperature of said heater, and said moving means controls the movement of said cleaning member in response to the temperature detected by said temperature detecting member.

4. An image heating apparatus according to claim 3, wherein said moving means places said cleaning member in contact with the surface of said rotary backup member when the temperature detected by said temperature detecting member exceeds a predetermined temperature.

* * * * *

UNITED STATES PATENT AND TRADEMARK OFFICE

CERTIFICATE OF CORRECTION

PATENT NO. : 5,512,729
DATED : April 30, 1996
INVENTOR(S) : KENSAKU KUSAKA, ET AL.

It is certified that error appears in the above-indentified patent and that said Letters Patent is hereby corrected as shown below:

Column 2,
line 18, "According" should read --According to--.
Column 3,
line 40, "10" should be deleted.
Column 5,
line 3, "surface" should read --surface of--; and
line 63, "L8" should read --18--.
Column 9,
line 31, "precess" should read --process--.
Column 10,
line 30, "surface" should read --surface of--.
Column 13,
line 42, "is" should read --is a--.
Column 14,
line 4, "has" should read --have--;
line 25, "was" should read --were--; and
line 32, "gap L:" should read --gap L;--.
Column 15,
line 28, "claim" should read --claimed--.

Signed and Sealed this

Twenty-fourth Day of September, 1996

*Attest:*

Bruce Lehman

BRUCE LEHMAN

*Attesting Officer*

*Commissioner of Patents and Trademarks*